US011548696B2

(12) United States Patent
Wood et al.

(10) Patent No.: US 11,548,696 B2
(45) Date of Patent: Jan. 10, 2023

(54) LID FOR A CONTAINER

(71) Applicant: MILTON INNOVATIONS LIMITED, Wellington (NZ)

(72) Inventors: Jason Taylor Wood, Wellington (NZ); Samuel Thomas Horgan, Auckland (NZ)

(73) Assignee: MILTON INNOVATIONS LIMITED, Wellington (NZ)

( * ) Notice: Subject to any disclaimer, the term of this patent is extended or adjusted under 35 U.S.C. 154(b) by 147 days.

(21) Appl. No.: 16/422,910

(22) Filed: May 24, 2019

(65) Prior Publication Data

US 2019/0276199 A1 Sep. 12, 2019

Related U.S. Application Data

(63) Continuation-in-part of application No. PCT/IB2017/057397, filed on Nov. 24, 2017.

(30) Foreign Application Priority Data

Nov. 25, 2016 (NZ) ..... 720514

(51) Int. Cl.
*B65D 47/20* (2006.01)
*A47G 19/22* (2006.01)
(Continued)

(52) U.S. Cl.
CPC ..... *B65D 47/2018* (2013.01); *A47G 19/2272* (2013.01); *B65D 25/46* (2013.01);
(Continued)

(58) Field of Classification Search
CPC .. B65D 47/2018; B65D 25/44; B65D 47/061; B65D 47/063; B65D 47/065; B65D 47/066
See application file for complete search history.

(56) References Cited

U.S. PATENT DOCUMENTS 3,907,179 A 9/1975 Pehr et al.
4,333,583 A 6/1982 Montemarano
(Continued)

FOREIGN PATENT DOCUMENTS

CA 2169339 C 5/1999
WO 2018089426 A1 5/2018

OTHER PUBLICATIONS

International Search Report and Written Opinion of International Search Authority for International Patent Application No. PCT/IB2017/057397.

*Primary Examiner* — Jeffrey R Allen
(74) *Attorney, Agent, or Firm* — JCIP; Joseph G. Chu; Jeremy I. Maynard

(57) ABSTRACT

A lid for covering the open end of a beverage container having: an annular base adapted to detachably and sealably engage with the circumference of a drinking edge of a container; an elevated portion projecting upwardly from the annular base; and a spout; the lid arranged and formed such that when in use with a container containing liquid and wherein the lid is securely fitted to the container a user is able to move the spout between a closed configuration which closes the open end of a container such that liquid is substantially prevented from escaping from the container and a drinking configuration which allows a user to drink the liquid contained within the container and also wherein in use the lid is adapted such that a user can squeeze the container or the elevated portion which results in the spout moving from a closed configuration to a drinking configuration.

2 Claims, 26 Drawing Sheets

(51) Int. Cl.

| | |
|---|---|
| ***B65D 43/02*** | (2006.01) |
| ***B65D 47/06*** | (2006.01) |
| ***B65D 25/46*** | (2006.01) |

(52) U.S. Cl.

CPC ..... *B65D 43/0218* (2013.01); *B65D 43/0222* (2013.01); *B65D 47/06* (2013.01); *B65D 47/063* (2013.01); *B65D 2543/005* (2013.01); *B65D 2543/00046* (2013.01); *B65D 2543/00092* (2013.01); *B65D 2543/00296* (2013.01); *B65D 2543/00351* (2013.01); *B65D 2543/00509* (2013.01); *B65D 2543/00518* (2013.01); *B65D 2543/00537* (2013.01); *B65D 2543/00555* (2013.01)

(56) References Cited

U.S. PATENT DOCUMENTS

| | | | |
|---|---|---|---|
| 5,390,810 | A | 2/1995 | Stroble et al. |
| 5,979,697 | A | 11/1999 | Kim |
| 6,644,490 | B2 | 11/2003 | Clarke |
| 7,513,382 | B2 | 4/2009 | Clarke et al. |
| 8,807,371 | B2 | 8/2014 | Zuares et al. |
| 9,398,822 | B2 | 7/2016 | Wille |
| 9,452,867 | B2 | 9/2016 | Koestring et al. |
| 10,201,241 | B2 | 2/2019 | Eickhoff et al. |
| 10,494,151 | B2 | 12/2019 | Oakes |
| 2005/0072787 | A1 | 4/2005 | Morris et al. |
| 2006/0086764 | A1 | 4/2006 | Dery |
| 2006/0201944 | A1 | 9/2006 | Shibasaka et al. |
| 2007/0131691 | A1 | 6/2007 | Evans |
| 2011/0036851 | A1 | 2/2011 | McCandlish et al. |
| 2014/0042178 | A1 | 2/2014 | Brannock |
| 2018/0065333 | A1 | 3/2018 | Crudgington |

FIGURE 22
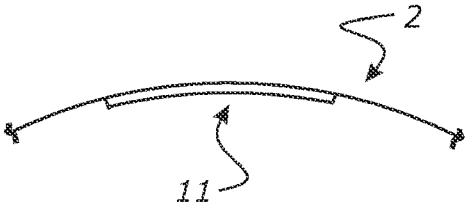
FIGURE 23
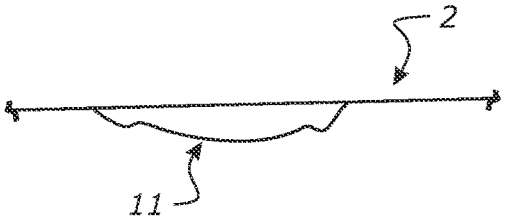
FIGURE 24
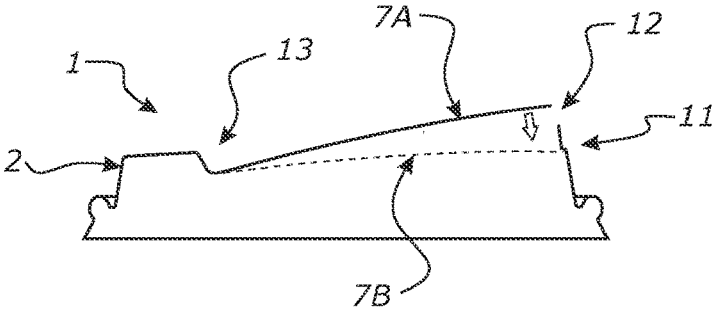
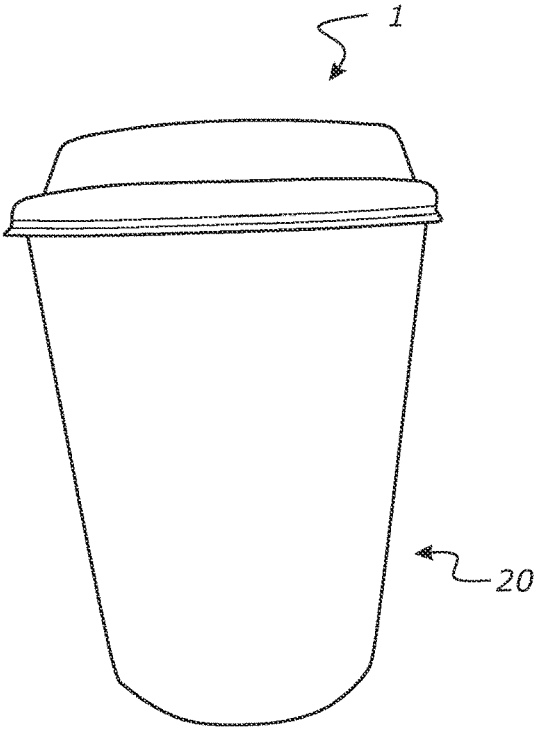
FIGURE 25
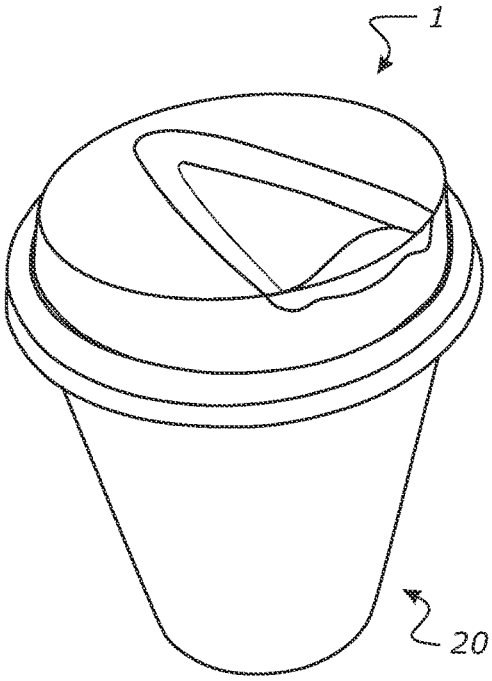
FIGURE 26

LID FOR A CONTAINER

CROSS-REFERENCE TO RELATED APPLICATIONS

The current application is a continuation-in-part patent application of PCT International Patent Application No. PCT/IB2017/057397 filed on Nov. 24, 2017, which claims priority to and the benefits of the New Zealand Patent Application No. 720514 filed on Nov. 25, 2016, the contents of which are incorporated in their entireties by reference herein.

FIELD OF INVENTION

The invention generally relates to a lid for a container. More particularly but not exclusively the invention relates to a lid for a beverage container.

BACKGROUND

Beverages such as takeaway coffee or hot chocolate are usually sold in takeaway cups or containers which have lids applied to them. These lids typically have an open drinking aperture in them and therefore there is a risk of the liquid spilling (or even injury in the case of hot beverages) through the aperture. Another known problem with these lids is that heat can escape through the drinking aperture and in some instances the lids can come off easily as they do not fit securely to the cups they are applied to. Even if the beverage is a cold beverage such as soft drink or cold coffee, liquid spillage through the aperture while drinking is still not desirable because such spill can not only create mess but can also cause stains in clothes, carpets etc.

It is an object of a preferred form of the present invention to go at least some way towards addressing one or some of the above problems. While this is an object of a preferred embodiment, it should not be seen as a limitation on the scope of the invention as claimed. The object of the invention per se is simply to provide the public with a useful choice.

As used herein the term "and/or" means "and" or "or", or both. As used herein "(s)" following a noun means the plural and/or singular forms of the noun. The term "comprising" as used in this specification and claims means "consisting at least in part of". When interpreting statements in this specification and claims which include that term, the features, prefaced by that term in each statement, all need to be present but other features can also be present. Related terms such as "comprise" and "comprised" are to be interpreted in the same manner.

SUMMARY OF THE INVENTION

According to one aspect of the invention there is provided a lid closing, or for closing, the opening of a container that is able to contain a flowable material, the lid comprising a peripheral region engaging, or able to engage, about, within, or both about and within, the container, and a non-peripheral region inwardly of the peripheral region; wherein the non-peripheral region has a formation i. able to be pressed or already pressed, to a condition that at least substantially closes a flowable material egress opening of the non-peripheral region, and ii. able to be released from that condition to allow material egress from the container via the material egress opening.

Preferably the condition that at least substantially closes the opening is a stable condition.

Preferably the condition that at least substantially closes the opening is so retained by a catch of the lid (preferably of the non-peripheral region).

Preferably the formation is a spout.

Preferably the formation is triangular in plan shape having a base adjacent the material egress opening and an apex that is more proximate an opposed edge of the non-peripheral region.

In a second aspect the present invention may be said to be a lid closing, or for closing, the opening of a container that is able to contain a flowable material, the lid comprising a peripheral region engaging, or able to engage, about, within or both about and within the container at the opening of the container and a non-peripheral region inwardly of the peripheral region; wherein the non-peripheral region has a formation i. able to be pressed, or already pressed, to a retainable or retained condition that at least substantially closes a flowable material egress opening of the non-peripheral region and ii. able to be released from that condition to allow flowable material egress via the opening.

Preferably the formation is live hinged save for where it is to define part of the material egress opening.

Preferably the formation is live hinged from the remainder of the non-peripheral region, save for where it is to define part of the material egress opening.

Preferably the non-peripheral region includes a planar region and the formation.

Preferably the live hinging (live hinged formation) is in a depression of the non-peripheral region preferably thereby to enable retention of part of the formation inwardly of the peripheral region.

Preferably the non-peripheral region includes a planar region and the formation intermediate of which the depression is located.

Preferably, when not retained, the formation can assume a stable condition above the peripheral region.

Preferably when not retained, the formation can assume a stable condition above the peripheral region that corresponds to the open condition of the egress opening.

Preferably the peripheral region is annular.

Preferably the non-peripheral region has an annular periphery.

Preferably the formation is of substantially a triangular form when viewed in plan but with a convex curvature at least at where the formation is to define part of the material egress opening.

Preferably the formation is biased to its material egress condition.

Preferably the formation is elongate and preferably substantially subdivides (preferably bisects) the non-peripheral region.

Preferably the formation extends across a majority of the distance of the non-peripheral region inwardly of the peripheral region.

Preferably capture of part of the formation is required for retention of the formation in its closing condition.

Preferably capture of the non-hinged part of the formation is required for retention of the formation in its closing condition.

Preferably the material egress opening is in part arcuate when viewed in side elevation.

Preferably the non-peripheral portion can be directly or indirectly squeezed in a horizontal direction perpendicular to the elongate direction of the formation, the squeezing causing the catch to displace relative to the formation and thereby releasing the formation from retention.

Preferably a rim of the formation defines the actuate profile of the opening. Preferably the rim of the formation in plan view is also arcuate.

Preferably the lid is of a thin walled construction.

Preferably the flowable material is a liquid material.

Preferably the liquid material is a beverage.

In a further aspect the present invention may be said to be a lid for covering a rim defined open end of a container that can contain a flowable material, the lid comprising:

an annular base adapted to detachably engage the rim of the container;

an elevated wall portion projecting upwardly from the annular base; and a spout;

the lid arranged and formed such that when in use, with a container containing a flowable material and the lid is fitted to the container, a user is able to move the spout between a closed configuration which closes the open end of the container such that the material is substantially prevented from escaping from the container and an open configuration which allows a user to pour the material contained within the container and also wherein in use the lid is adapted such that a user can squeeze the container or the lid which results in the spout moving from the closed configuration to the open configuration.

Preferably the spout is hinged.

Preferably the spout has a tab adapted such that a user can pull the tab to move the spout to an open configuration or push the tab to move the spout to a closed configuration.

Preferably the elevated portion is substantially annular.

Preferably the elevated portion is greater in height above the base in a first side wall portion than a diametrically opposed second side wall portion.

Preferably the first side portion is about 10 mm in height and the second side portion is about 8 mm in height above the base.

Preferably the lid has an inner annular wall adapted to engage with the inside wall of a container.

Preferably the elevated portion (preferably an inward facing wall thereof) is adapted and configured to releasably engage with the spout when the spout is in a closed configuration.

Preferably the elevated portion comprises a catch which is adapted to releasably receive part of the spout when it is in a closed configuration.

Preferably the elevated portion comprises a catch which is adapted to releasably receive part of the spout when it is in a closed configuration, the spout biased by the hinge to the open configuration but prevented to moving to the open configuration when the spout is received by the catch.

Preferably it is made from material(s) which is/are biodegradable.

Preferably the lid is made substantially from biodegradable plastic.

In a further aspect the present invention may be said to be a lid as herein described when in use with a container.

Preferably the container is a disposable hot beverage container.

Preferably a user can squeeze the container and/or lid, the squeezing resulting in the spout moving from a closed configuration to an open configuration when in the closed configuration.

Preferably a user can squeeze the container and/or lid in a direction parallel to the direction in which the spout engages and disengages with the catch, the squeezing resulting in the spout moving from a closed configuration to an open configuration when in the closed configuration.

Preferably in use a user can squeeze the elevated portion which results in the spout, when in the closed configuration, moving from the closed configuration to the open configuration.

Preferably in use a user can squeeze the annular base which results in the spout, when in the closed configuration, moving from the closed configuration to the open configuration.

In still a further aspect the present invention may be said to be a lid closing, or for closing, the opening of a container that is able to contain a flowable material, the lid comprising a peripheral region engaging, or able to engage, about, within or both about and within the container at the opening of the container and a lid top provided inwardly of the peripheral region;

wherein the lid top includes an integrally formed spout formation that, by a live hinge, is substantially separated from the rest of the lid top, the spout formation:

i. able to be pressed, or already pressed, to a retainable or retained condition that at least substantially closes a flowable material egress opening of the non-peripheral region and ii. able to be released from that condition to allow flowable material egress via the opening.

Preferably the spout formation is elongate and extends across at least half of the lid top.

Preferably spout formation extends at least 75% across the lid top.

Preferably the spout formation is elongate and straight and extends from a first peripheral region of the lid top towards an opposed peripheral region of the lid top, the egress opening provided at said first peripheral region.

Preferably the egress opening is defined by the end of the spout formation and the first mentioned peripheral region.

Preferably the egress opening is able to be closed when the spout formation is depresses, the closure being created by end of the spout and the first mentioned peripheral region coming into contact with each other.

Preferably when depressed, the end of the spout formation is closer to the first mentioned peripheral region than when released.

Preferably the end of the spout is able to be retained in the depressed condition by a catch of the first mentioned peripheral region.

Preferably the first mentioned peripheral region comprises an annular rim able to be secured to the opening rim of the container and an annular wall extending upwardly relative the rim to the lid top.

Preferably the annular wall together with the end of the spout formation form the egress opening.

Preferably the annular wall extends from the annular rim to the lid top.

Preferably the annular wall is substantially vertical.

Preferably the annular wall has a catch formation provided with which the end of the spout can lodge to be retained in the depressed condition.

Preferably the annular wall at the catch formation can be caused to displace relative the end of the spout in a radial direction upon a compression of the lid top in a direction lateral to the elongate direction of the spout formation.

In a further aspect the present invention may be said to be a lid to releasably engage to the rim of an open topped cup or container, the lid comprising a. a lip engaging, or able to engage, about, within or both about and within the rim of the container, b. an annular wall extending upwardly relative the lip, c. a lid top at the top of the annular wall the lid top comprising an elongate formation presenting a spout, the end of which is elevated above the annular wall and defines a closable opening with and at the annular wall via which material in the container can egress, the formation separated at least partially from the remainder of the lid top by a live hinge to allow:

i. the spout to be depressed towards the lip to cause the end of the spout to contact the annular wall to thereby close the closable opening, and ii. the lid top to be compressed in a direction lateral to the elongate direction of the formation to deform the spout and the annular wall.

Preferably the end of spout when depressed is able to lodge under a catch formation of the annular wall (preferably provides on the inside of the wall) to be retained by the catch formation and retain the closable opening in the closed condition.

Preferably the lodged condition of the spout with the catch is able to be dislodged upon a compression of the lid top causing relative movement of the end of the spout with the catch.

Preferably the live hinge is adapted and configured to bias the spout away from the depressed condition of the spout so that when the spout is dislodged from the catch the spout assumes a condition where the closeably opening is open.

Preferably the lid is able to be compressed but naturally moves back to its non-compressed state.

Preferably the live hinge is of a resiliently deformable nature.

Preferably the spout of a resiliently deformable nature.

In a further aspect, the invention may also be said to reside in a lid for closing an opening of a container that is adapted to contain a flowable material, the lid comprising a peripheral region engaging, or able to engage, about, within, or both about and within, the container, and a non-peripheral region inwardly of the peripheral region;

wherein the non-peripheral region has a formation, the formation being i. able to be pressed or already pressed, to a closed condition that at least substantially closes a flowable material egress opening of the non-peripheral region, and ii. able to be released from the closed condition to an open condition to allow material egress from the container via the material egress opening.

Preferably, the formation is a spout.

Preferably, the formation is triangular in shape having a base adjacent the material egress opening and an apex that is more proximate an opposed edge of the non-peripheral region.

Preferably, the formation is live hinged save for where it is to define part of the material egress opening.

Preferably, the live hinging (live hinged formation) is in a depression of the non-peripheral region preferably thereby to enable retention of part of the formation inwardly of the peripheral region.

Preferably, wherein when not retained, the formation assumes a stable condition above the peripheral region.

Preferably, the peripheral region is annular.

Preferably, the formation is biased to the open condition.

Preferably, the formation extends across over half of distance of the non-peripheral region inwardly of the peripheral region.

Preferably, the lid comprises a catch that is adapted to capture of part of the formation for retaining the formation in its closing condition.

Preferably, the material egress opening is in part arcuate.

Preferably, the lid comprises an annular internal extension projecting downwardly from or relative to the base, the annular internal extension being configured to fit at least partially inside the container during use.

Preferably, the formation extends from or proximal to a lid top to or towards a base of the lid with the material egress opening facing towards the lid top.

Preferably, the lid further comprises a first gripping portion formed at one side of the formation and a second gripping portion formed on at another side of the spout, wherein squeezing of the first and second gripping portions is adapted to cause the formation to transition from the closed condition to the open condition.

Preferably, the gripping portion comprises a textured profile to facilitate gripping using user's finger(s).

Preferably, wherein applying the force on the formation towards the peripheral region is adapted to cause the formation to transition from the open condition to the closed condition.

Preferably, the lid further comprises an air circulation hole for improving the fluid flow.

Preferably, the lid further comprises a horizontal surface to allow stacking of the container onto the lid.

Preferably, the lid comprises:

an annular base adapted to detachably engage the rim of the container;

an elevated wall portion projecting upwardly from the annular base; and a spout;

the lid arranged and formed such that when in use, with a container containing a flowable material and the lid is fitted to the container, a user is able to move the spout between the closed condition which closes the open end of the container such that the material is substantially prevented from escaping from the container and an open condition which allows a user to pour the material contained within the container and also wherein in use the lid is adapted such that a user can squeeze the container or the lid which results in the spout moving from the closed condition to the open condition.

Preferably, the spout is hinged.

Preferably, the spout has a tab adapted such that a user can pull the tab to move the spout to the open condition or push the tab to move the spout to a closed condition.

Preferably, the elevated portion is substantially annular.

Preferably, the elevated portion is greater in height above the base in a first side wall portion than a diametrically opposed second side wall portion.

Preferably, the first side wall portion is about 10 mm in height and the second side wall portion is about 8 mm in height above the base.

Preferably, the lid has an inner annular wall adapted to engage with the inside wall of a container.

Preferably, the elevated portion (preferably an inward facing wall thereof) is adapted and configured to releasably engage with the spout when the spout is in the closed condition.

Preferably, the lid comprises a catch which is adapted to releasably receive part of the spout when it is in a closed condition.

Preferably, the catch is located at the lid top.

Preferably, the catch is located at the elevated portion.

Preferably, the catch is adapted to releasably receive part of the spout when the spout is in a closed condition, the spout being biased by the hinge to the open condition but prevented to moving to the open condition when the spout is received by the catch.

Preferably, the lid made from material(s) which is/are biodegradable.

Preferably, the lid is made substantially from biodegradable plastic.

Preferably, the lid is adapted to be in use with a container.

Preferably, the container is a disposable hot beverage container.

Preferably, when in a closed condition, application of force to the container and/or lid by the squeezing results in the spout moving from the closed condition to the open condition.

Preferably, when in closed condition, the application of force by squeezing the container and/or lid in a direction parallel to the direction in which the spout engages and disengages with the catch results in the spout moving from the closed condition to the open condition.

Preferably, application of force by squeezing the elevated portion results in the spout, when in the closed condition, moving from the closed condition to the open condition.

Preferably, application of force by squeezing the annular base results in the spout, when in the closed condition, moving from the closed condition to the open condition.

In a further aspect, the invention may also be said to reside in a lid to releasably engage to the rim of an open topped cup or container, the lid comprising:

a. a lip engaging, or able to engage, about, within or both about and within the rim of the container,
b. an annular wall extending upwardly relative the lip,
c. a lid top at the top of the annular wall, the annular wall comprising an elongate formation presenting a spout, the end of which is elevated above the lid top and defines a closable opening with and at the lid top via which material in the container can egress, the formation separated at least partially from the remainder of the annular wall by a live hinge to allow:
   i. the spout to be depressed towards the annular wall to cause the end of the spout to contact the lid top to thereby close the closable opening, and
   ii. the annular wall to be compressed in a direction lateral to the elongate direction of the formation to lift the spout away from the annular wall to thereby open the closable opening.

In a further aspect the present invention may also be said to be a lidded container comprising a lid as herein described and a rim defined open top container at where the lid is secured.

In a further aspect the present invention may also be said to be a container with a lid located at the top of a container portion of the container, the lid as herein described.

Preferably the lid is integrally formed with the container portion.

Preferably the lid is removable from the container portion.

These and other features, objects and advantages of the present invention will be readily apparent to persons of ordinary skill in the art upon reading the entirety of this disclosure, which includes the accompanying drawings and claims.

BRIEF DESCRIPTION OF THE DRAWINGS

Some preferred embodiments of the invention will now be described by way of example and with reference to the accompanying photos and drawings, of which:

FIG. 22 shows a plan cross sectional detail view of the catch.

FIG. 23 shows a side schematic cross sectional detail view of the catch.

FIG. 24 shows a side schematic view of the spout in an open and closed configuration.

FIGS. 25 and 26 show a lid and a container.

DETAILED DESCRIPTION

Figure 1:
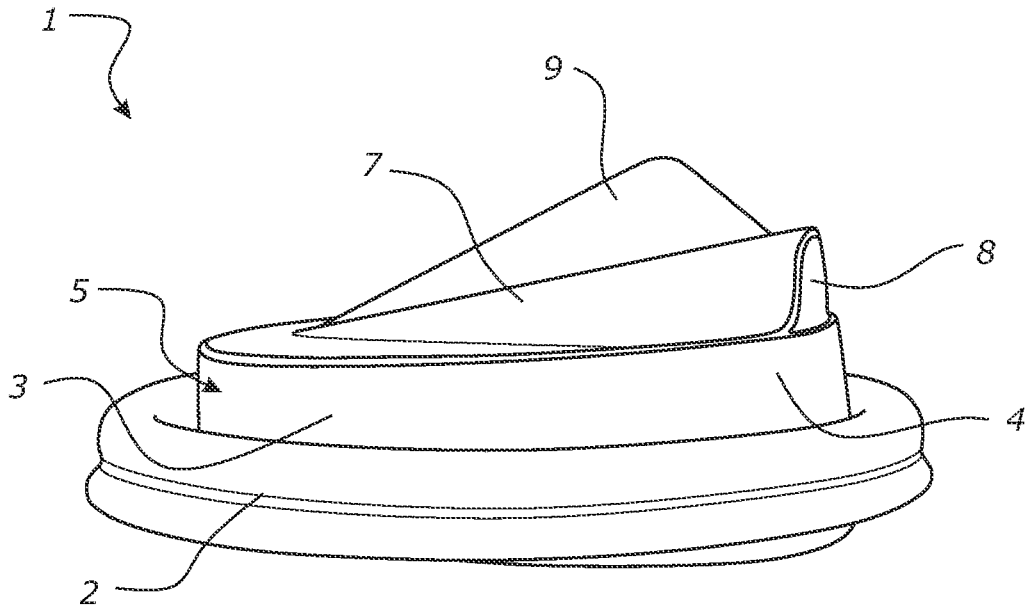
FIG. 1 is a perspective side view of a lid having a spout which is in an open configuration.

FIG. 1 shows a lid 1 for covering the open end of a container 20. The container 20 may be a beverage cup such as a coffee cup as an example. It may be disposable. The cup is preferably made from material that allows its side walls to flex inwards. The lid 1 is most preferably used on a takeaway disposable beverage container 20 with an annular rim that defines the open top of the container. Other container or container types are also envisaged. The material to be contained can be of many types but is preferably a hot beverage or such as coffee, tea, soup or hot chocolate etc. The beverage can be a cold beverage too such as cold coffee, smoothies, soft drinks, condiments etc. The lid 1 may be permanently secured to the container or removable retained to the container 20.

Figure 20:
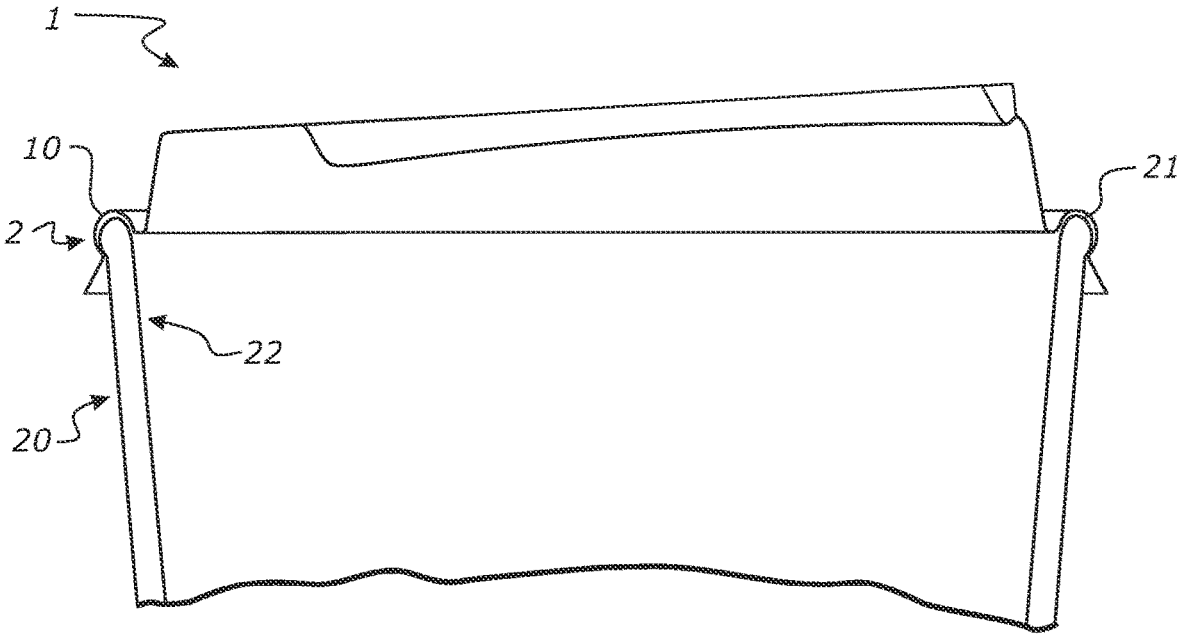
FIG. 20 is a cross sectional view of a lid along the length of the spout in the closed configuration, attached to a container.

The lid 1 preferably has an annular base 2 with an annular rim 10. The base 2 is adapted to releasably engage with the outside of the top of a container 20 (as shown in FIG. 20 for example) such that in use it preferably substantially sealably fits about the circumference of an edge 21 of a container 20.

Dependent from the base 2 is preferably an annular elevated portion 3. The annular elevated portion may comprise of a lid top and an annular wall that extends between the lid top and the base. It is preferably peripherally inward of the base (when seen in plan view). A first region 4 of the elevated portion 3 is preferably of greater in height above the base than an opposite second region 5. The difference in elevation between the two regions 4 and 5 is not critical to the operation of the opening and retaining of a spout 7. The difference in height between the first region 4 and second region 5, of the elevated portion 3 may help to create a pitch which allows liquid in the container when in use to flow further into a user's mouth.

The first and second regions 4,5 are preferably diametrically opposed each other on the elevated portion 3.

Figure 2:
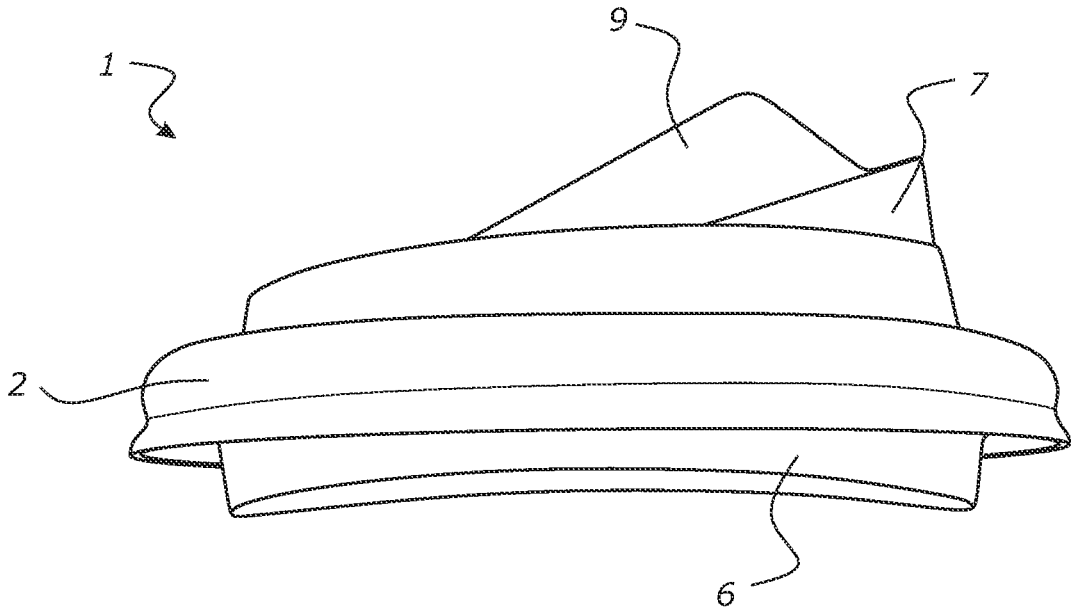
FIG. 2 is a side view of the lid wherein the spout is in an open configuration.
Figure 21:
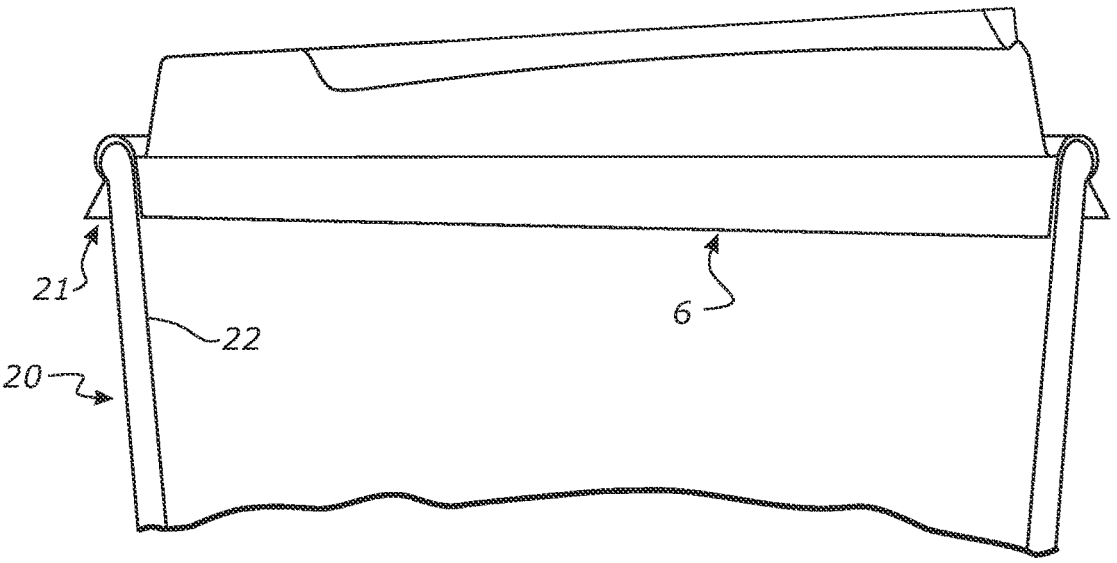
FIG. 21 shows a cross sectional view of a lid attached to a container.

As shown in FIGS. 2 and 21, projecting downwardly from or relative to the base 2 may be an annular internal extension 6 which when in use fits inside a container. The extension 6 is configured to assist application of the lid 1 to the container and to make the attachment of the lid 1 to the container more stable. The extension 6 preferably has a snug fit inside the inside wall 22 of the container. The extension 6 further aids prevention of liquid leaking out between the container and the lid, by creating a further seal between the extension 6 and the inside wall 22 of the container.

Forming part of the elevated portion 3 is a formation to define the spout 7. It is herein also described as being a formation of the lid top. It is preferably provided as part of the lid top. The spout 7 is preferably elongate. Preferably the spout is hinged at its periphery. The hinge is elongate and runs about at least part of the spout. Preferably the spout is formed of or as a pliable member or region of the elevated annular portion (eg at the lid top) and preferably extends across a substantial portion of the footprint of the lid 1. The hinge may be a hinge region at each side of the spout. The hinge may extend about the entire connected periphery of the spout 7. In the preferred embodiment the hinge is a living hinge. The hingeable nature of the hinge is at least in part determined by the stiffness and flexibility of material that it is made from, as well as the preformed configuration and shape of the hinge. The hinge allows the lid top to be compresses in a direction lateral to the elongate direction of the spout 7. Preferably the spout 7 extends from a peripheral region of the lid top and to or towards an opposite peripheral region of the lid top. Preferably the spout 7 is located to substantially dissect and preferably bisect the elevated portion 3 (lid top).

Preferably the spout 7 is of substantially a triangular form (preferably an isosceles triangle) when viewed in plan where the base of the triangle is at or near the periphery of the elevated annular portion and the apex is proximate an opposed region of the periphery of the elevated annular portion. The spout preferably has a convex upward curvature over its length as shown drawings when the spout is in the open configuration. The spout is shown in the open or drinking configuration in FIGS. 1-3, 5-13, 16 and 18.

The lid 1 has an aperture 8 via which liquid can flow so that a user can drink the contents of the container when the spout 7 is in the open or drinking configuration. In one embodiment, the aperture 8 is at the elevated first region 4. When the spout 7 is in a closed configuration this aperture 8 is closed. Preferably the closed aperture 8 creates a seal sufficient to help prevent liquid from the egressing from the aperture 8. The seal is preferably established between the end 12 of the spout and the annular wall of the elevated portion 3.

The hinge facilitates the spout 7 to move between the open and closed condition/configuration. The hinge preferably biases the spout to the open configuration. In some forms, the hinge may also be able to bias the spout to the closed configuration. This may occur when the spout 7 is in the closed configuration. In other forms the spout 7 may be retained, against the bias to the open configuration, in the closed configuration.

In one embodiment, the spout 7 in the open condition is preferably more stable than the spout 7 in the closed condition. I.e. the spout 7 may be biased towards being in the open condition by the hinge. When in the closed condition, pulling the spout 7 upwards away from the annular base and/or squeezing of the lid 1, will or will cause to move (eg spring) the spout 7 towards the open configuration. Preferably the direction of the squeezing at the periphery is orthogonal to the elongate direction of the spout 7. I.e. the squeezing forces from a user are on either side of the spout 7. This will be explained more later. Preferably only pushing on the spout 7 downwards will force the spout 7 to its closed condition.

Moving from the closed condition to the open condition, the spout 7 may utilise an over centre type mechanism. In such a form, to move from the closed condition, to the open condition, the spout 7 must pass over a particular point where it is biased towards the open configuration. Once the spout 7 has gone past its over centre point, it does not easily return to the closed configuration without an external input. In other embodiments, the spout 7 always wants to be in it is open configuration even when closed, and is only in its closed configuration when actively retained in its closed configuration. This may be achieved by a catch 11.

The spout 7 may be retained in its closed condition by the catch 11. When a user, or other means such as a manufacturing machine or packing machine, closes the open spout 7A (wherein A represents the open configuration) to the closed condition the closed spout 7B (wherein B represents the closed configuration) can catch on the catch 11 as shown in the schematic FIG. 24. The way of manufacturing the catch 11 may be by a number of means, however in the preferred embodiment the catch 11 is an undercut formed in the annular wall at for example first region 4. The end 12 of the spout 7 can lodge under the undercut when the spout is in the closed condition. When the spout 7 is not retained by the catch 11, it can return to its open condition. This may occur under the bias caused by the hinge. In other embodiments the catch may be a flexible hook, barb, interference fit or other similar element or device or feature.

The preferred action of squeezing the annular base 2, or lid 1, or cup 20, in a direction orthogonal to the direction of the spout, and towards the centre of the annular base 2, will have the effect of moving the catch 11 away from the end 12 of the spout 7. In one embodiment, where the container 20 is a circular rimmed cup, the effect of squeezing the container 20 to a more elliptical shape will move the catch 11 away from the end 12 so as to release from the spout 7. The spout can then move or caused to be moved to its open condition. As described above, once the spout 7 is released from the catch 11 it can return to the open condition, i.e., open configuration.

Another method of releasing the spout 7, is to pull the catch 11 away from the end 12. A further method of releasing the spout 7, is to pull up on the spout 7. The effect of pulling on the spout 7 will merely bend the spout 7 so that it can get out from underneath the catch 11.

Figure 12:
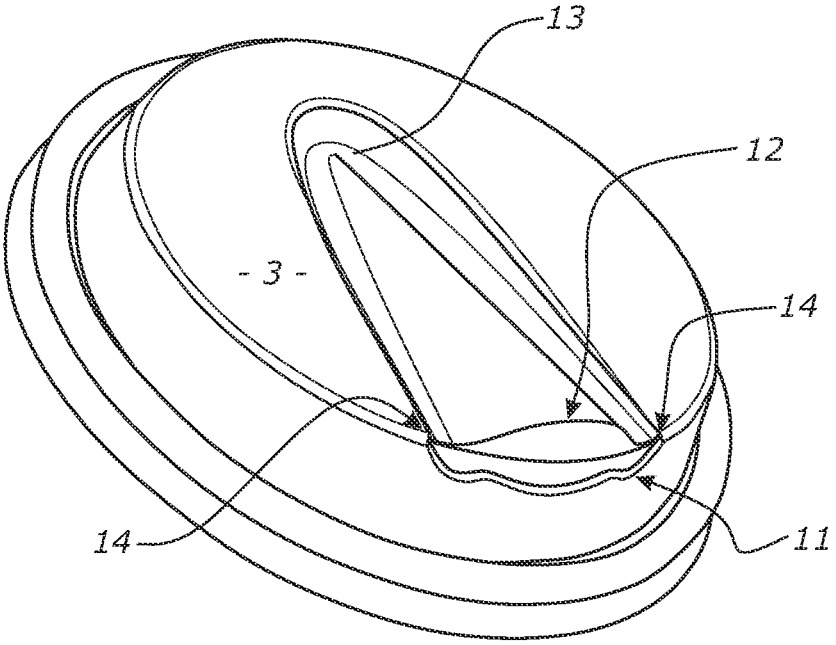
FIG. 12 is a top perspective view of a lid of a $1^{st}$ configuration.

The end 12 of the spout 7 is connected at sides 14 (as shown in FIG. 12) to the annular wall and/or the lid top.

Figure 13:
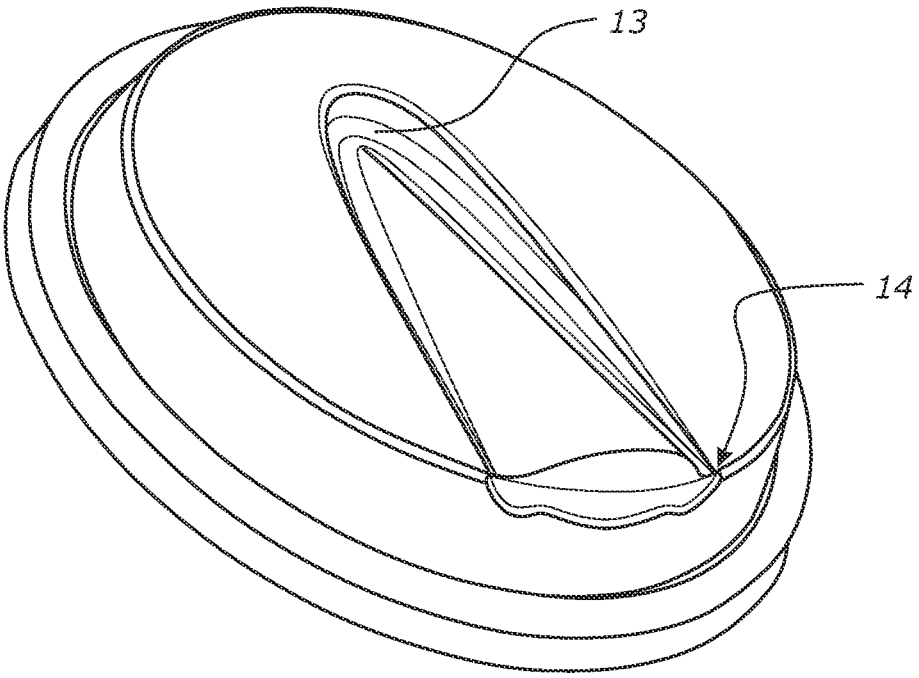
FIG. 13 is a top perspective view of a lid of a $2^{nd}$ configuration.
Figure 14:
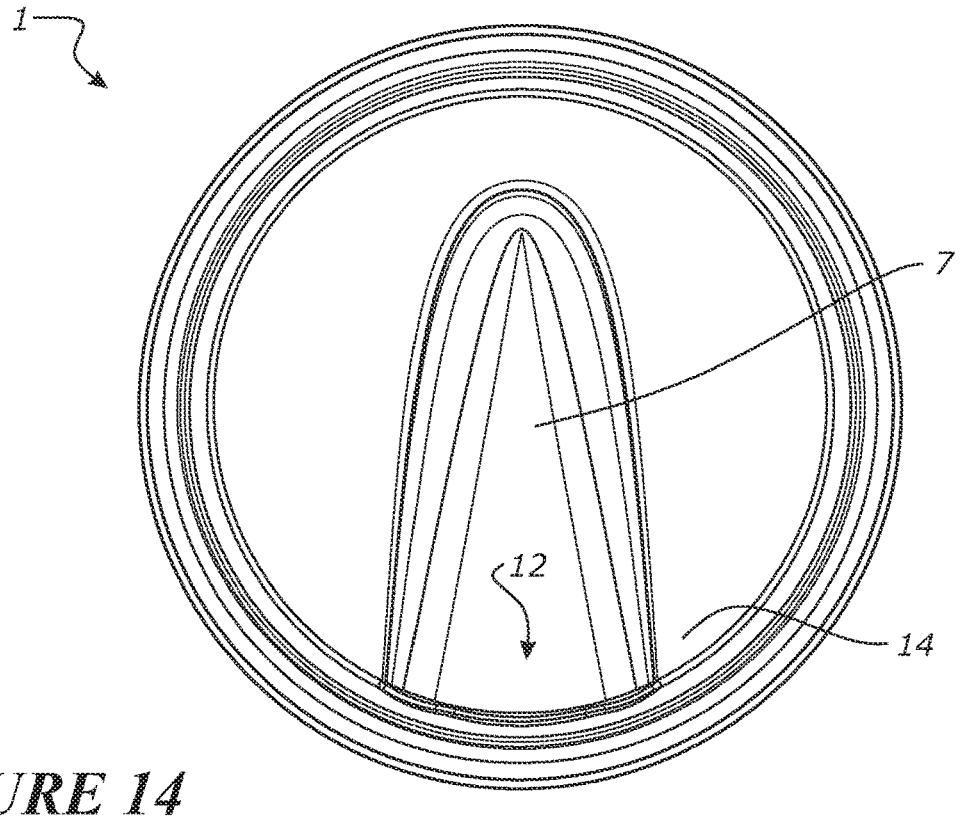
FIG. 14 is a top view of the lid of the $1^{st}$ configuration.
Figure 15:
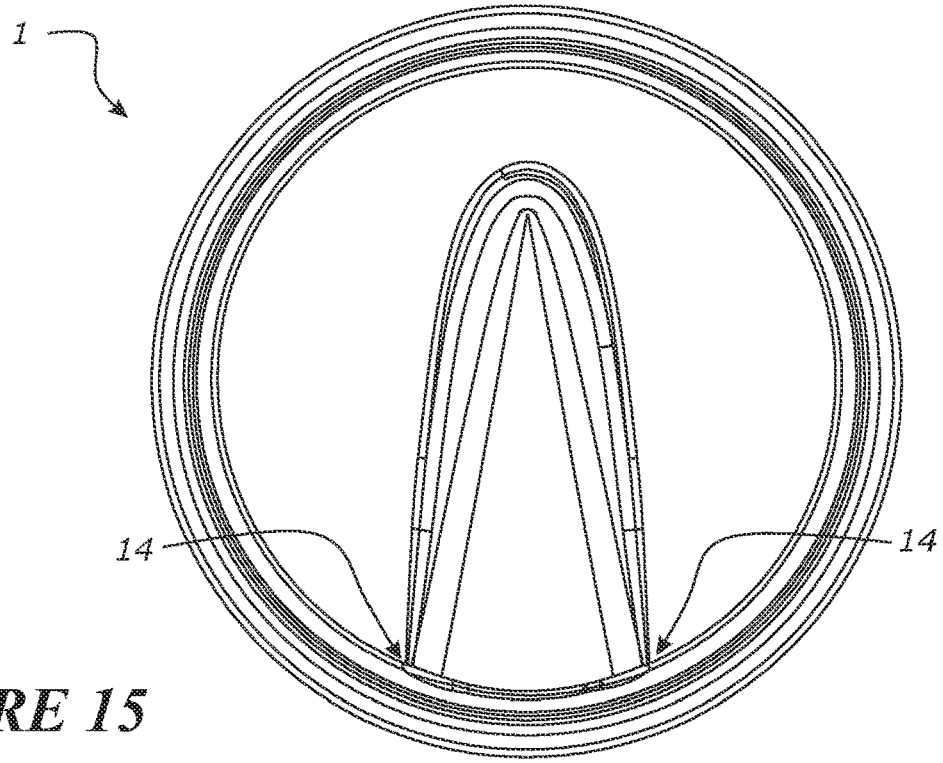
FIG. 15 is a top view of the lid of the $2^{nd}$ configuration.
Figure 16:
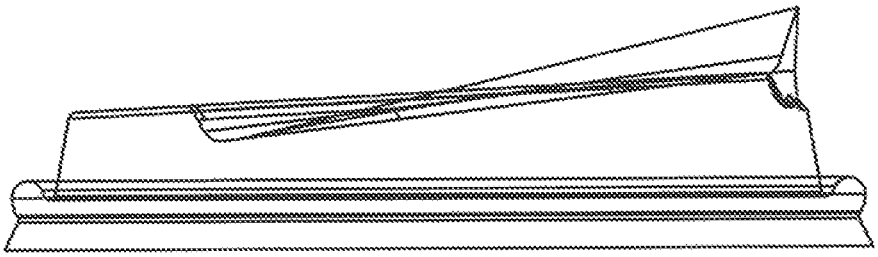
FIG. 16 is a cross sectional view along the length the spout of a lid in the open configuration.
Figure 17:
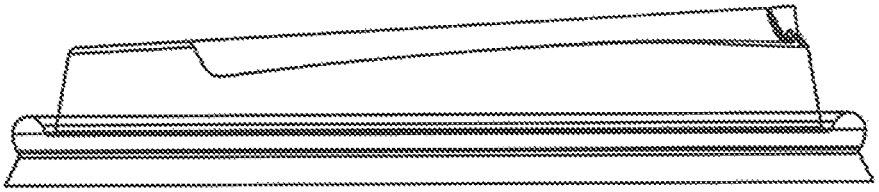
FIG. 17 is a cross sectional view along the length of the spout of a lid in the closed configuration.
Figure 18:
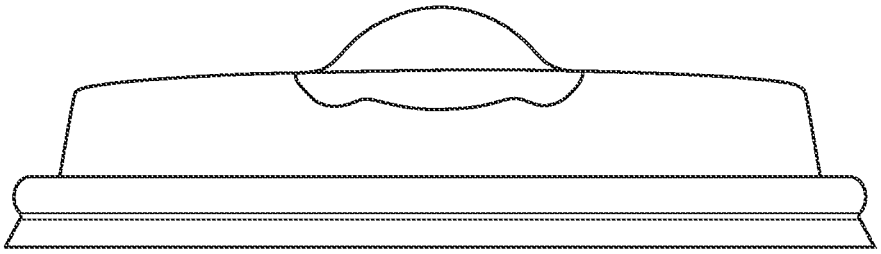
FIG. 18 is a front view of a lid with the spout in the open configuration.
Figure 19:
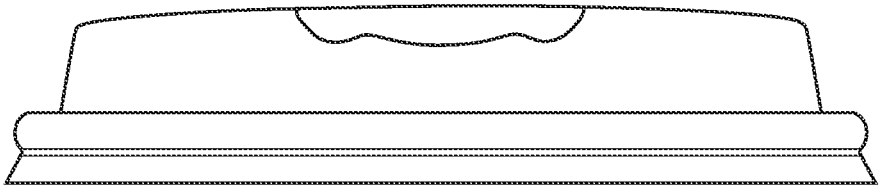
FIG. 19 is a front view of a lid with the spout in the closed configuration.

A further preferred feature of the spout 7 is that it's "pivot point" 13, as shown in FIGS. 12, 13 and 24, is preferably lower than the sides 14. This allows the lid to be manufactured as one piece, yet still allow the spout 7 to be long enough so that the end 12 of the spout is still able to be caught, and retained, by the catch 11. The sides 14 provide the flex for the spout to allow the end 12 of the spout to displace downwards so as to get caught under the catch 11.

The spout 7 and aperture 8 may be adapted such that they help to provide a natural flow of liquid when open and in use. The dimensions of the spout and aperture 8 based around at least one of (a) typical mouth size of users (b) liquid volumes to escape and (c) comfortable angles for the liquid to pour into a user's mouth.

Figure 3:
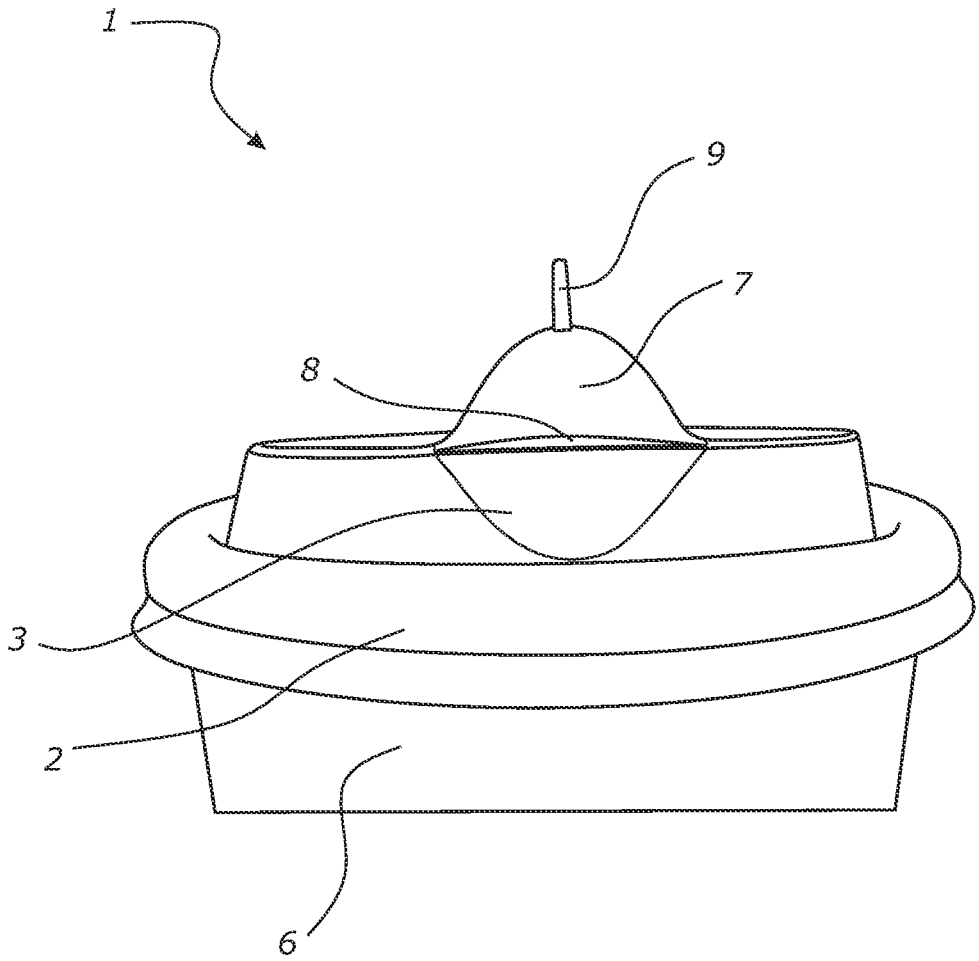
FIG. 3 is a front view of the lid wherein the spout is in an open configuration.

In one embodiment, the spout 7 may have a tab 9. This is preferably shaped like a fin. The purpose of the tab 9 is so that a user has another means, aside from the preferred sidewall squeezing, to open the hinged spout 7 when it is in its closed configuration. It may also be used to push down on the tab 9 to close the spout 7 when it is in its open configuration. FIGS. 1 and 2 both show the lid 1 with the aperture 8 fully open whereas FIG. 3 shows the lid 1 with the aperture 8 only slightly open. In some embodiments instead of integrally forming part of the raised annular portion 3 the spout 7 and tab 9 are separate parts which are connected to the raised annular portion 3 and each other with an adhesive or by welding or the like.

Figure 4:
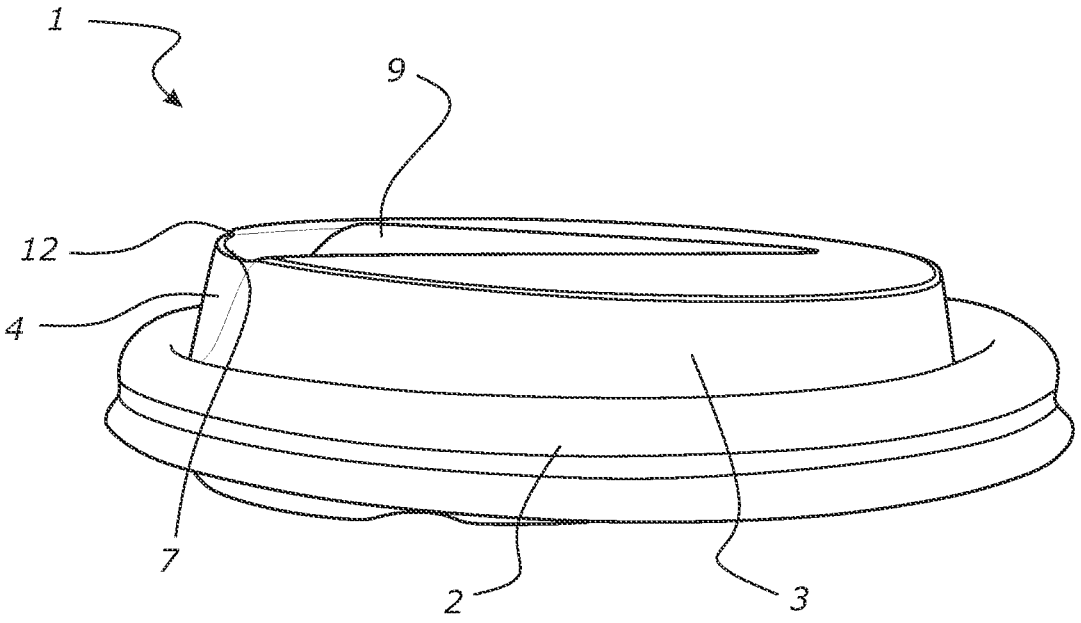
FIG. 4 is a side view of the lid wherein the spout is in a closed configuration.

FIG. 4 shows the hinged spout 7 in a closed position. The hinged spout 7 which has a lengthwise hinge allows the spout 7 to open and close within itself and has a triangular like shape when looking in plan. The spout is preferably semi-conical in form. As shown in FIG. 4 the end 12 of the hinged spout 7, when it is in a closed configuration, may sit substantially sealably against the inside of the annular wall of elevated portion 3 and/or against a downward facing surface of the catch 11. As described above there is preferably a small shelf or catch of the elevated portion 3 (at the annular wall) to help secure the spout 7 such that it may be retained by the catch 11 in its closed configuration. In use a user can pull open the spout 7 from its closed condition, by pulling on the tab 9, alternatively, the user can squeeze the cup or parts of it, towards a more elliptical shape so the shelf or catch is moved away from the end of the spout 7. In some embodiments the container (which the lid is covering the opening of the container) when squeezed will result in the spout 7 popping up by itself. In which case a tab 9 is not needed. The lid itself (either the elevated annular portion 3 or the base 2) can also be squeezed which also results in the spout 7 popping up by itself from its closed condition.

Figure 5:
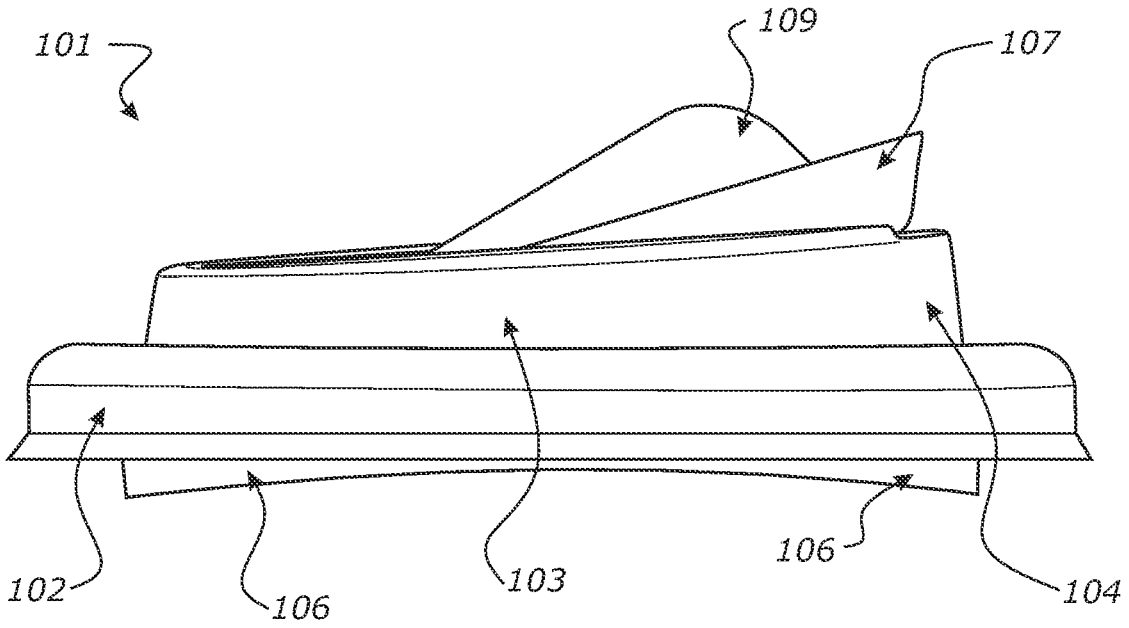
FIG. 5 is a side view of an alternative embodiment of a lid having a hinged spout which is in an open configuration.

FIG. 5 shows another embodiment of a lid 101 for covering the open end of a beverage container. It is envisioned that all features and constructions discussed above, may be applied to this embodiment and various other embodiments of the lid. The numbering system is also retained however this embodiment is prefixed with 10.

The lid 101 has an annular base 102 with an annular rim which is adapted to releasably engage with the outside of the top of a container such that in use it preferably substantially sealably fits about the circumference of a drinking edge of a container. The diameter of the lid 101 can be manufactured according to the size of the container. Projecting upwardly from the base 102 is an annular elevated portion 103 and as can be seen one first region 104 of the elevated portion 103 is greater in height than the other second region 5. The first region 104 of the elevated portion 103 is preferably about 10 mm in height from the base 102 whereas the second region 105 is preferably about 8 mm in height from the base 102. Projecting downwardly from the base 102 may be an annular internal extension 106 which when in use fits inside a container to assist application to the container and to make the attachment of the lid 101 to the container more stable, this is described above as the extension 6.

Figure 6:
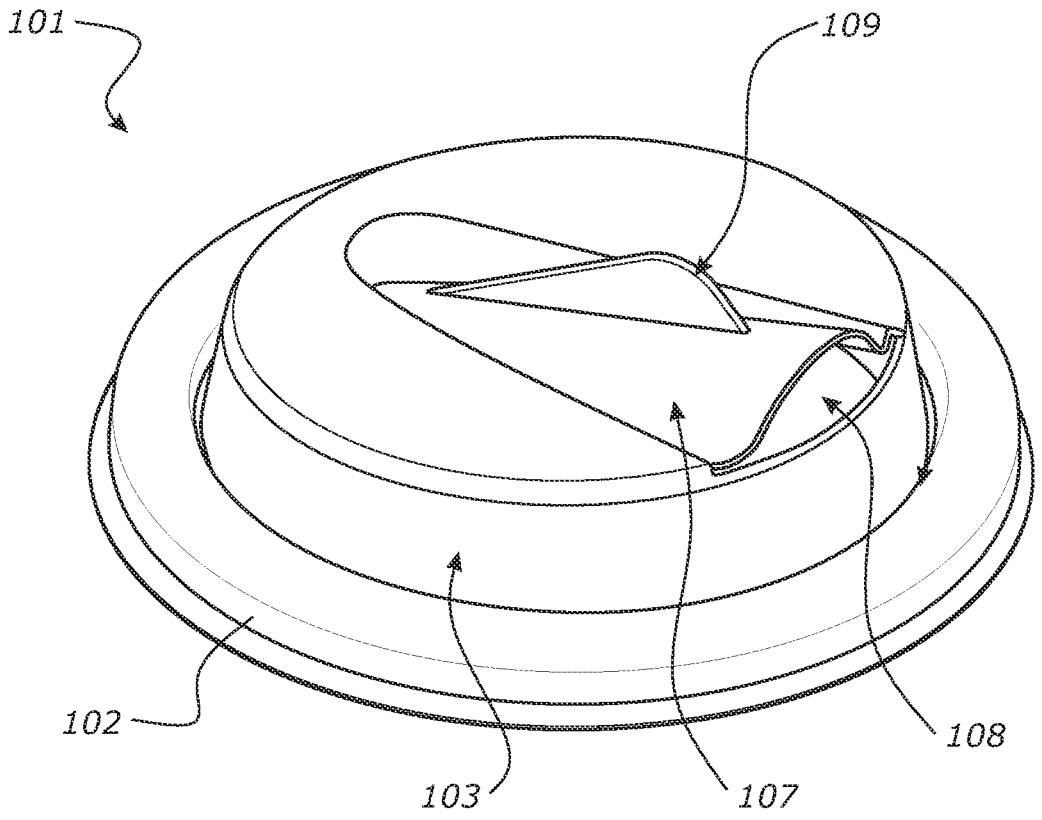
FIG. 6 is a perspective view of the lid with the spout in an open configuration.
Figure 7:
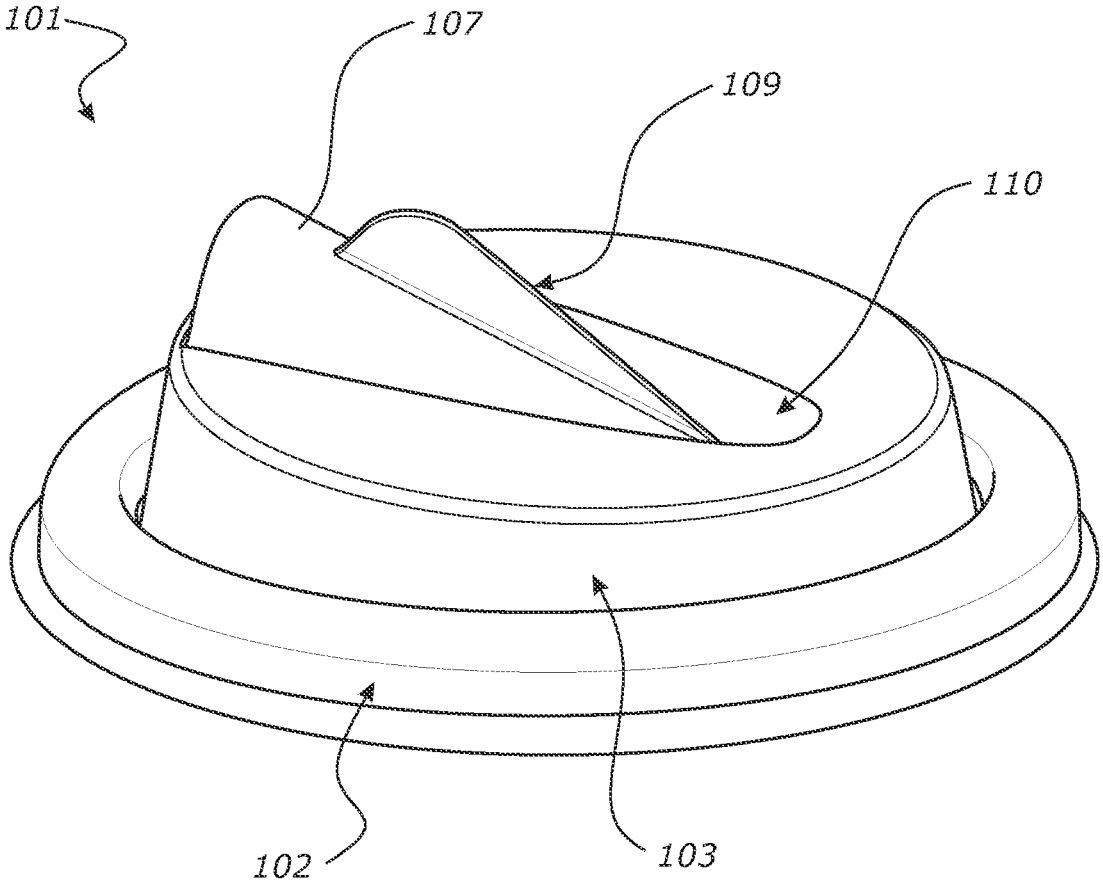
FIG. 7 is an alternative perspective view of the lid with the spout in an open configuration.
Figure 8:
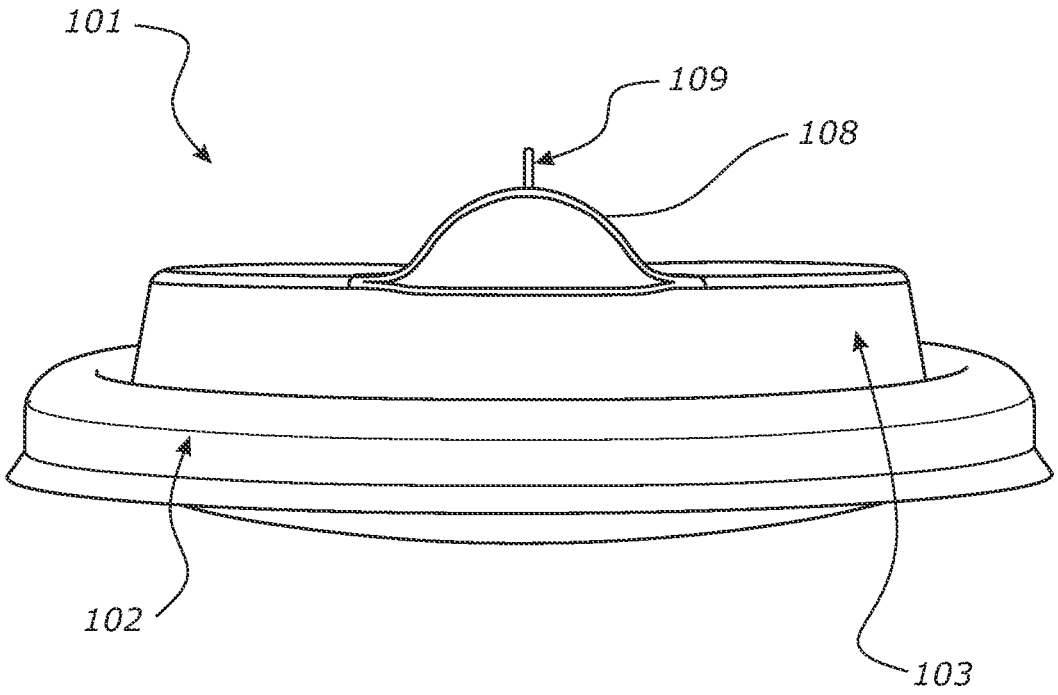
FIG. 8 is a front view of the lid wherein the spout is in an open configuration.
Figure 9:
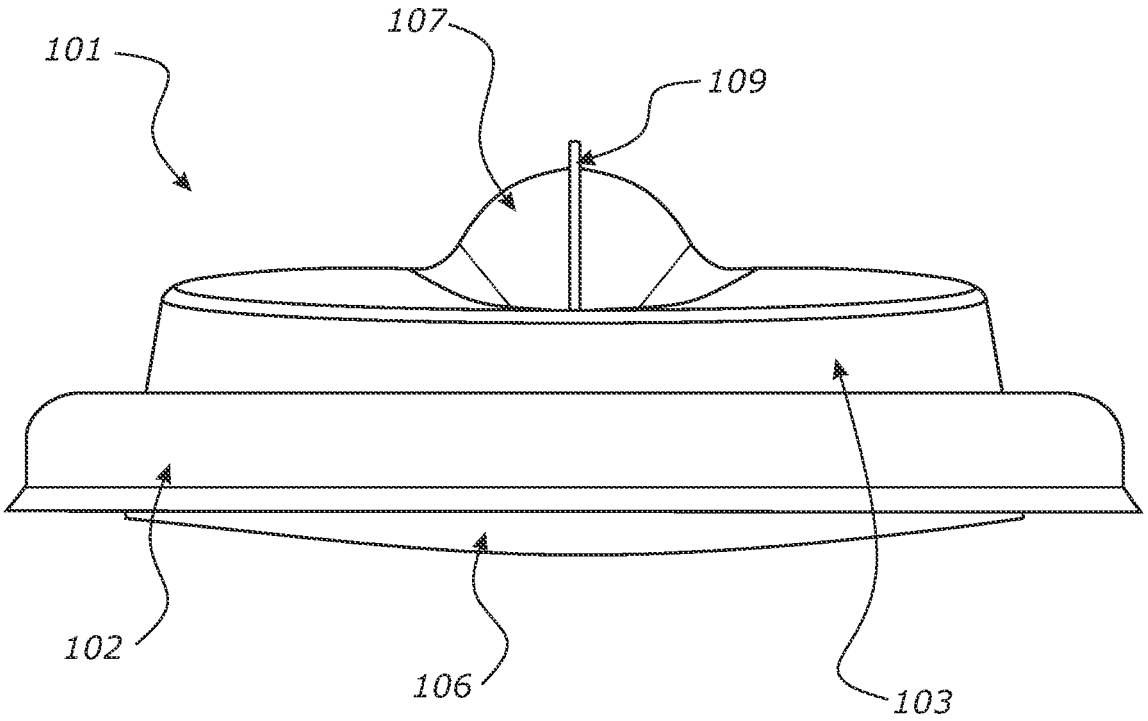
FIG. 9 is a rear view of the lid wherein the spout is in an open configuration.
Figure 10:
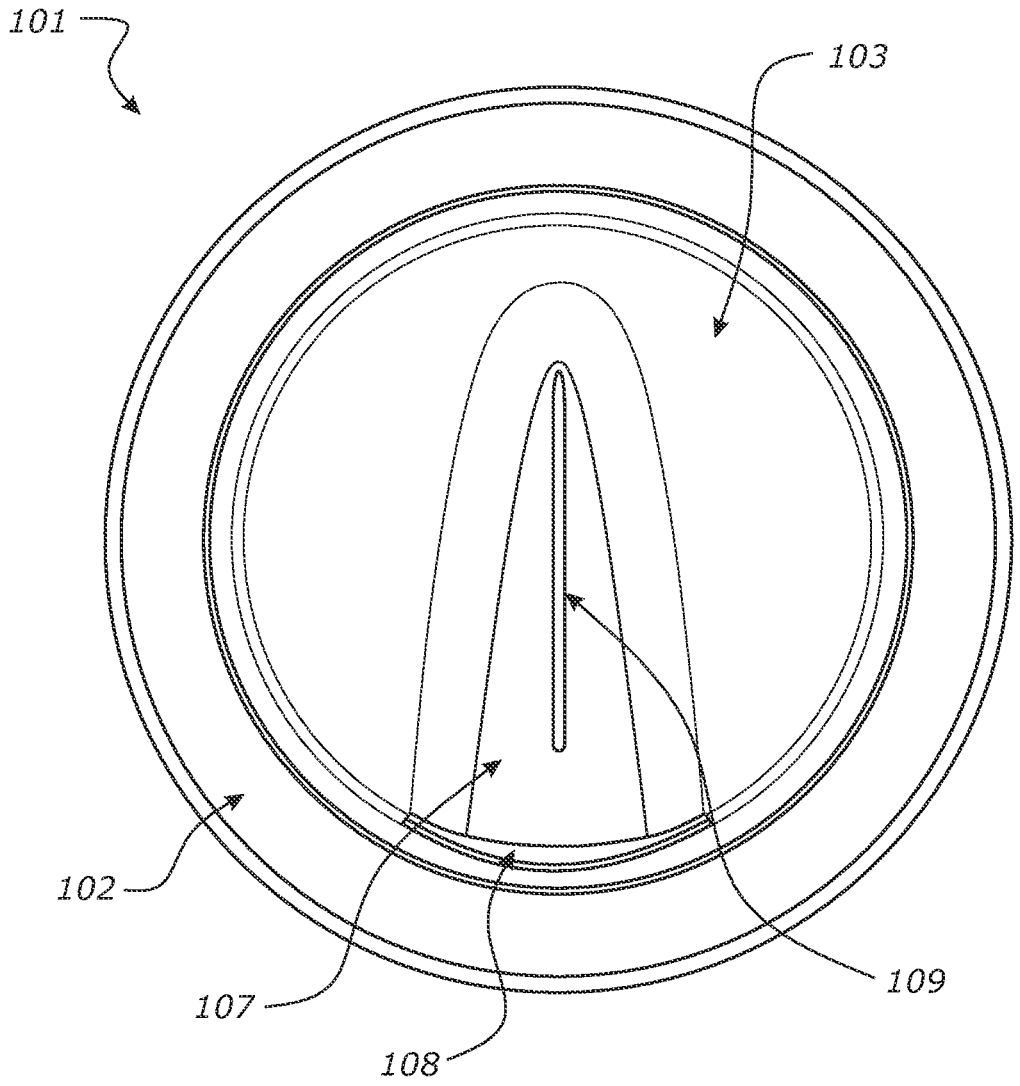
FIG. 10 is a top view of the lid wherein the spout is in an open configuration.
Figure 11:
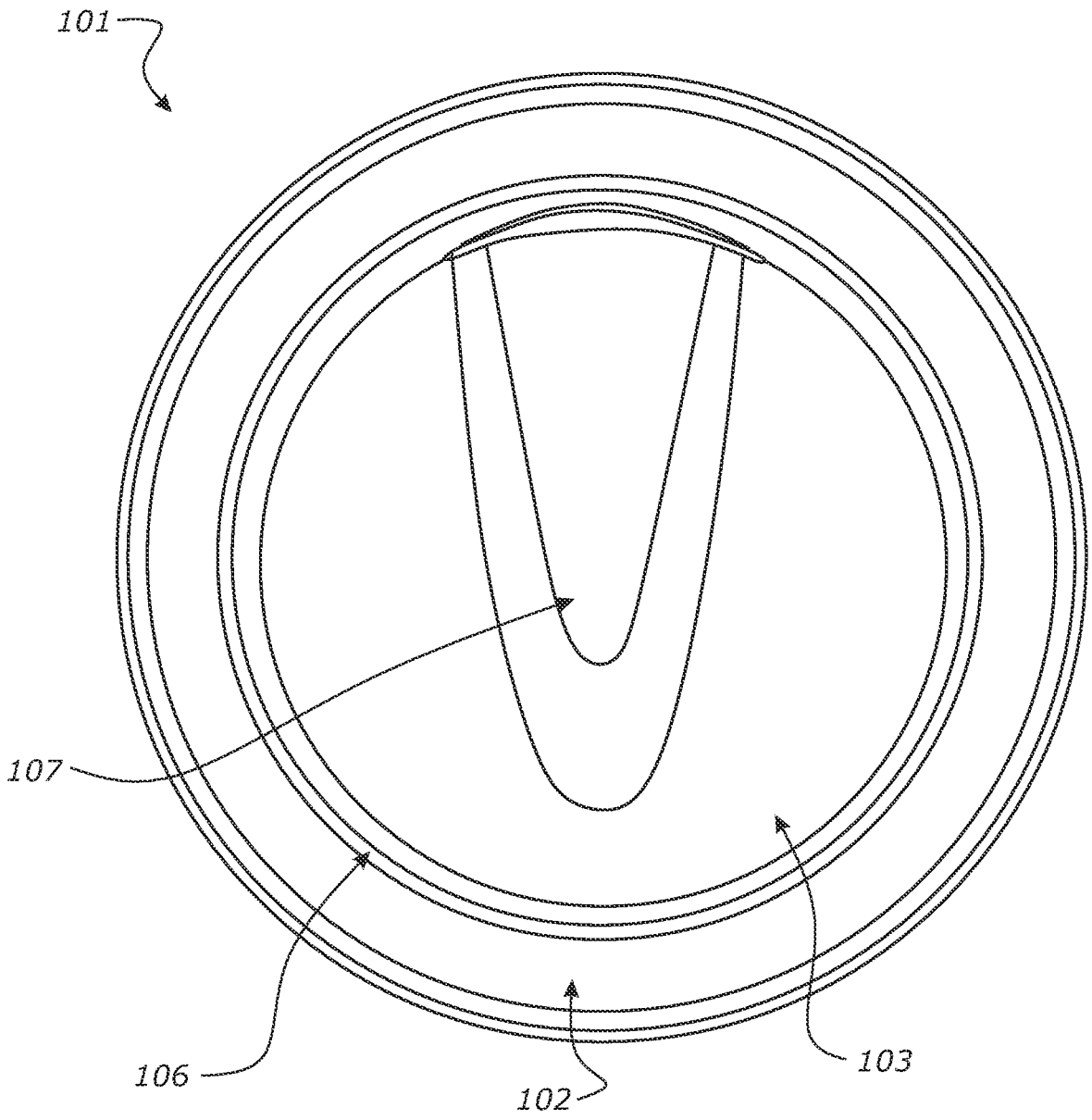
FIG. 11 is a bottom view of the lid wherein the spout is in an open configuration.

As shown in FIGS. 5-10 the lid also has a spout 107 which is shown in the open or drinking configuration. As can be seen in FIGS. 6 and 8 the lid 101 has an aperture 108 which liquid can flow from so that a user can drink the contents of the container. The width of the aperture 108 at the opening of the spout 107 is preferably about 26 mm wide. The maximum height of the opening of the spout 107 when in a drinking configuration is preferably about 7 mm, however it may be between 4 and 30 mm depending on the size of the container and/or spout. The spout 107 and the aperture 108 have been adapted such that they may provide a natural flow of liquid when in use in the spout's open condition, with dimensions based around for example a typical mouth size of users, liquid volumes to escape and comfortable angles for the liquid to pour into a user's mouth. The difference in height between the two regions 104, 105, of the lid 101 creates a pitch which may allow liquid of the container when in use to flow further into a user's mouth. As can be seen on top of the spout 107 is preferably a tab 109 which is shaped like a fin. The purpose of the tab 109 is so that a user can pull open the hinged spout 107 when it is in its closed configuration or to push down on the tab 109 to close the spout 107 when it is in its open configuration. The distance from the front of the spout 7 to the tab 109 is preferably about 12.5 mm. Also, as can be seen in FIG. 7 the top of the annular portion 103 has a recess 110. This may be about 4 mm in depth.

In use, a user places the annular rim of the base 2, 102 around the circumference of a drinking edge of a disposable container and the inner annular 6, 106 wall inside the container such that a secure fit is made. A user can then decide whether to keep the spout 7, 107 closed to transport the contained liquid and help maintain the temperature of the liquid or to open the spout 7, 107 by either popping the spout 7, 107 open or by pulling the tab 9, 109 which results in the spout 7, 107 moving to a drinking or open configuration. Once the spout 7, 107 is in the drinking configuration, a user can drink the liquid contained within the container via the aperture 8, 108. As the hinged spout 7, 107 can be opened and closed the user can either finish drinking all the liquid or close the spout 7, 107 and drink the remaining liquid at a later point in time.

Those skilled in the art will appreciate that the spout 7, 107 which can be opened and shut can come in different configurations and shapes and need not be limited to the embodiments disclosed (e.g. it doesn't need to be lengthwise hinge in a cone or triangle like shape). A closed condition may mean that some liquid can still escape. It may not be a complete fluid tight seal. A holding of the container upside down may for example allow liquid to trickle from the lid via the closed spout 7, 107.

FIGS. 27-43 show a yet another embodiment of a lid 201 for covering the open end of a beverage container 220. The embodiment of the lid 201, in its design and functionality, largely corresponds the embodiment of the lid 1 of FIG. 1 as described above. In particular, in FIGS. 27-43, like or identical parts have been given the same reference numeral raised by 200. Thus, it is here mainly referred to the explanations given above and, primarily, only the differences will be discussed in detail.

As shown in FIGS. 27-43, the lid 201 has an annular base 202 with an annular rim which is adapted to releasably engage with the outside of the top of a container 220 such that in use it preferably substantially sealably fits about the circumference of a drinking edge of a container 220. The annular rim may be adapted to releasably engage with the outside of the top of a container 220, preferably about the circumference of a drinking edge of a container 220 with a snap fit arrangement. The diameter of the lid 201 can be manufactured according to the size of the container 220. Projecting upwardly from the base 202 is an annular elevated portion 203 and as can be seen in FIG. 30 one first region 204 of the elevated portion 203 is greater in height than the other second region 205. The first region 204 of the elevated portion 203 is preferably about 10 mm in height from the base 202 whereas the second region 205 is preferably about 8 mm in height from the base 202. Although not shown in FIGS. 27-42, an annular internal extension that is similar to annual internal extension 106 may optionally project downwardly from the base 202 which when in use fits inside a container to assist application to the container and to make the attachment of the lid 201 to the container more stable.

Preferably, the lid 207 comprises a horizontal surface. Such horizontal surface can allow stacking of the cup/container onto the lid 207.

Preferably, the lid top may comprise a tapered surface or surface that is shaped in such a way that user can drink the liquid inside the container comfortably. The shape may be configured to suit the face or part of the face of the user that may come in contact with the lid top during use.

As shown in FIGS. 27-43, the lid 201 also has a spout 207 which can be moved between an open configuration and a closed configuration. The open configuration is shown in FIGS. 29, 30, 31, 32, 34, 35, 37, 40, 41 and 43 and a closed configuration is shown in FIGS. 33, 36, 38, 39 and 42.

Figure 29:
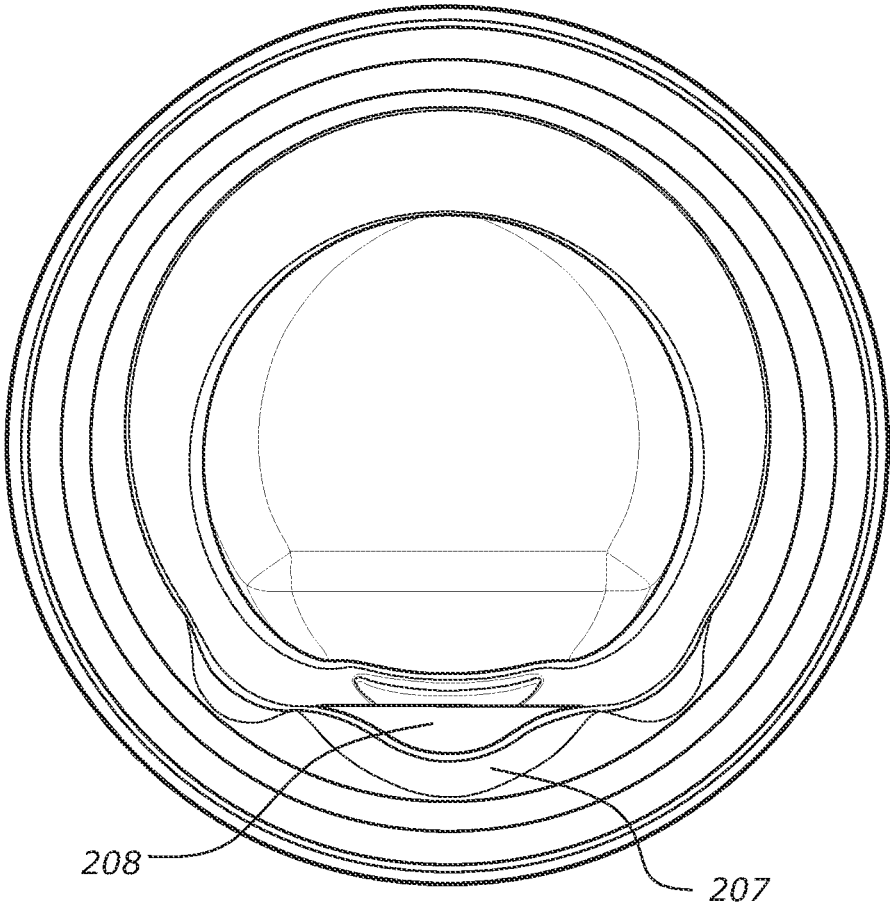
FIG. 29 is a top plan view of the lid of FIG. 27 with the spout in the open configuration.
Figure 30:
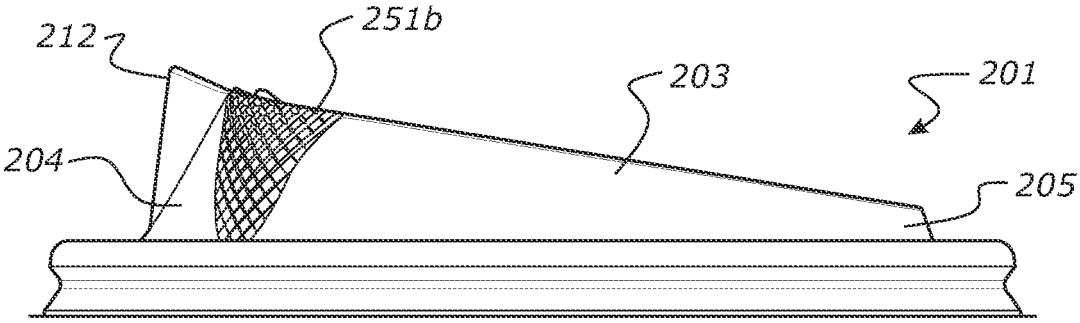
FIG. 30 is a side view of the lid of FIG. 27 with the spout in the open configuration.
Figure 31:
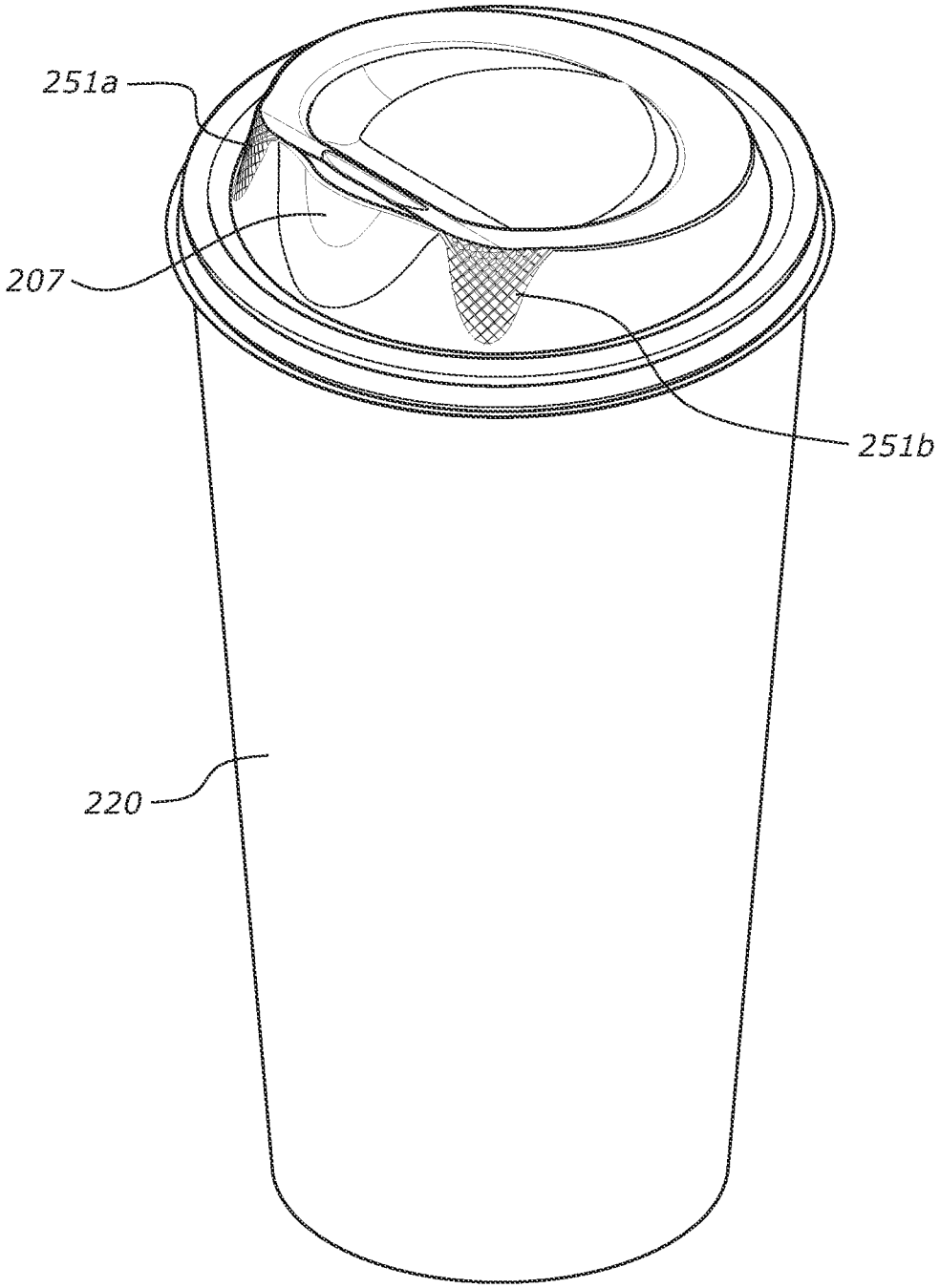
FIG. 31 is a perspective view of the lid of FIG. 27 with the spout in the open configuration, the lid being attached to a container.
Figure 32:
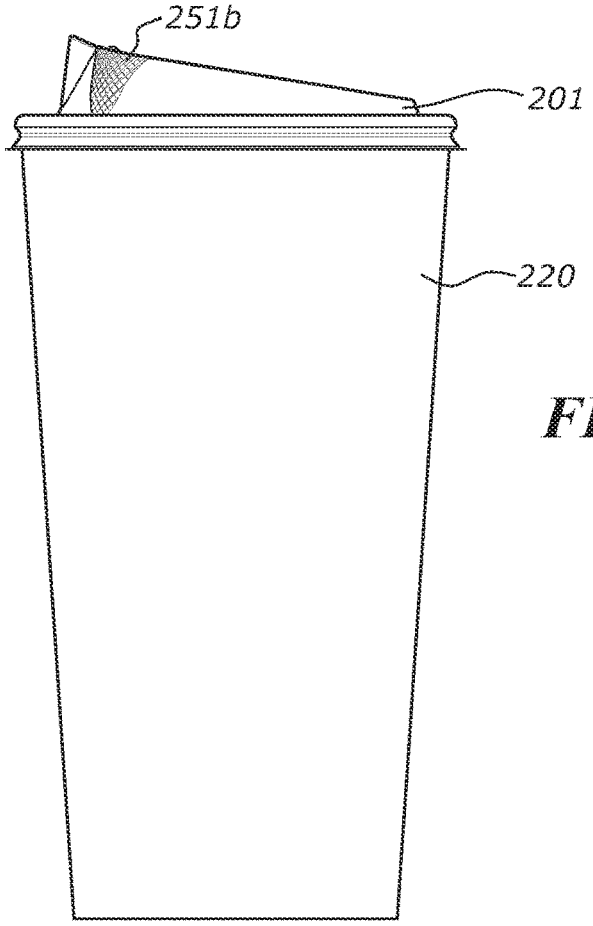
FIG. 32 is a side view of the lid and container of FIG. 31 showing the spout in the open configuration
Figure 33:
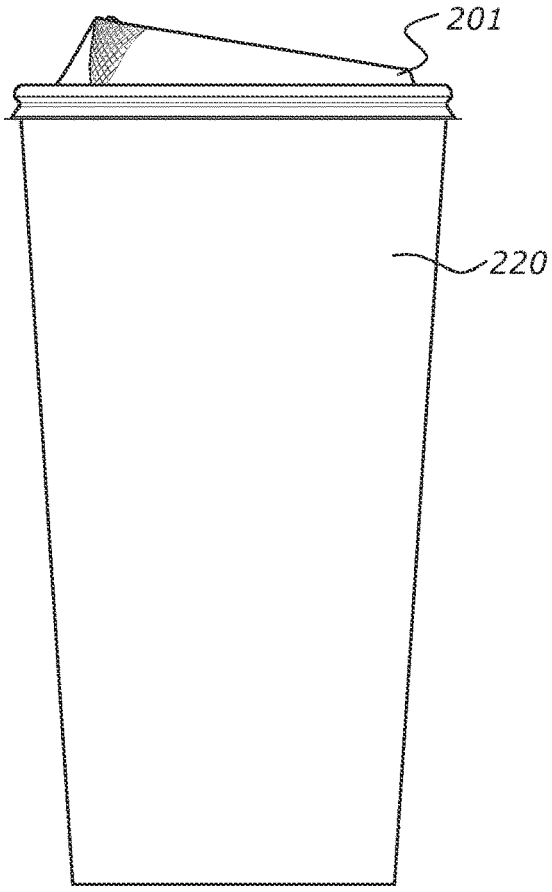
FIG. 33 is a side view of the lid and container of FIG. 31 showing the spout in the closed configuration.
Figure 34:
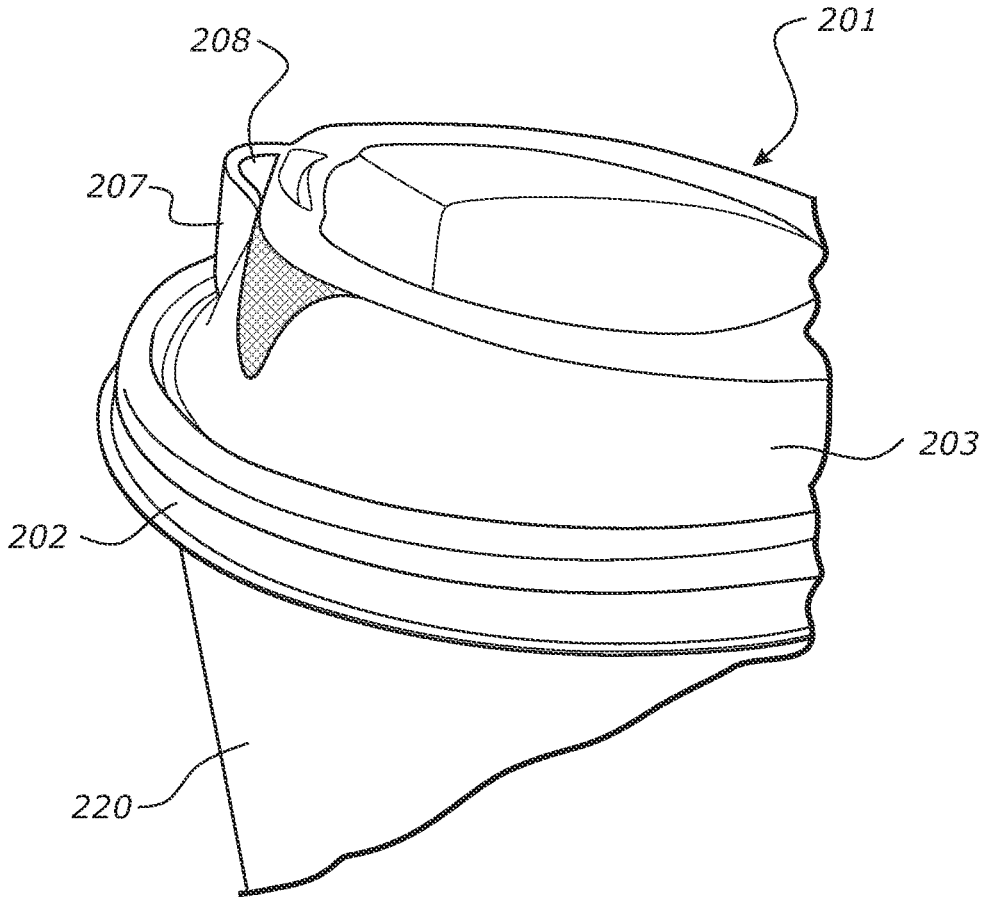
FIG. 34 is a partial perspective view of the lid and container of FIG. 31 showing the spout in the open configuration.

As can be seen for example in FIGS. 29 and 34, the lid 201 has an aperture 208 which liquid can flow from. The aperture 208 may be considered a drinking aperture to allow a user to drink the contents of the container 220. A user can place their lips onto the lid surrounding the aperture to allow cup/container 220 content to be poured through the aperture into the mouth of the user. The width of the aperture 208 at the opening of the spout 207 is preferably about 26 mm. The maximum extension of the opening of the spout 207 when in a drinking configuration (open configuration) is preferably about 7 mm, however it may be between 4 mm and 30 mm depending on the size of the container and/or spout 207. The spout 207 and aperture 208 have been adapted such that they may provide a natural flow of liquid when in use in the spout's open condition, with dimensions based around for example a typical mouth size of users, liquid volumes to escape and comfortable angles for the liquid to pour into a user's mouth. The difference in height between the two regions 204, 205, of the lid 201 creates a pitch which may allow liquid of the container 220 when in use to flow further into a user's mouth.

From the above description and from FIGS. 29-42, it can be appreciated that unlike in lids 1, 101 of the previous embodiments, the spout 207 in the lid 201 of the present embodiment extends vertically or substantially vertically between and preferably from the lid top to or towards the base 202. The spout 207 is formed on the elevated annular portion 203. Hence, the orientation of the spout 207 in this embodiment is different from the orientation of the spout 7, 107 as described in the previous embodiments. Also, the location of the spout 207 is different from that of the preceding embodiments. Unlike spout 7, 107 that extends along the lid top preferably over half of the distance of the lid top, the spout 207 extends along first region 204 of the elevated portion 203 that is in the form of an annular wall extending upwardly relative the lip or rim of the base 202. The aperture 208 faces towards the top of the lid 201 rather than on side.

Preferably, apart from the orientation and location of the spout 207, the structure and/or shape of the spout 207 is same as the structure and/or shape of the spout 7, 107 as described above. Similarly, the hinge arrangement of the spout 207 at the periphery of the spout may also be same or at least similar as hinge arrangement of the spout 7, 107 as described above.

Figure 27:
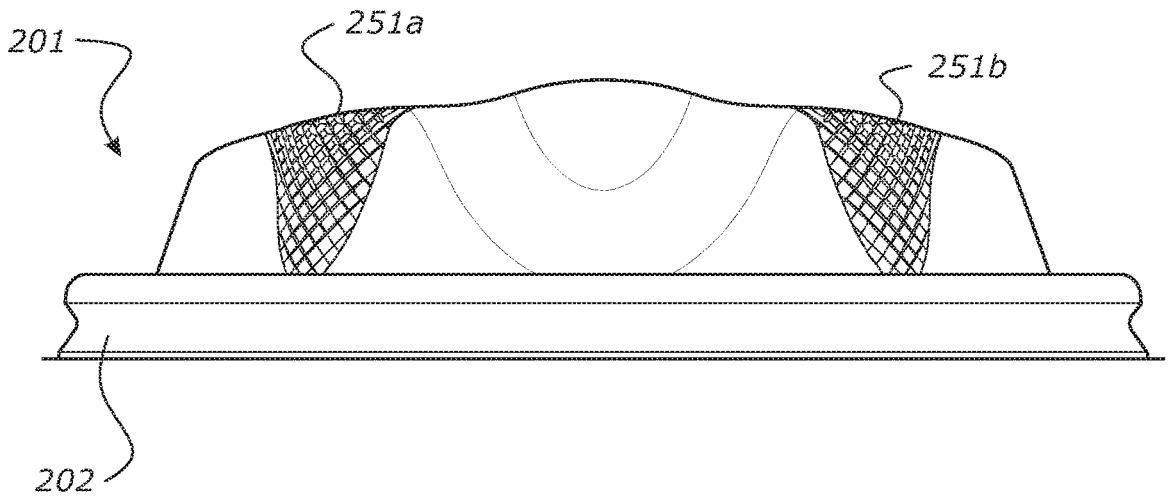
FIG. 27 is a front view of a lid an alternative embodiment of a lid.
Figure 28:
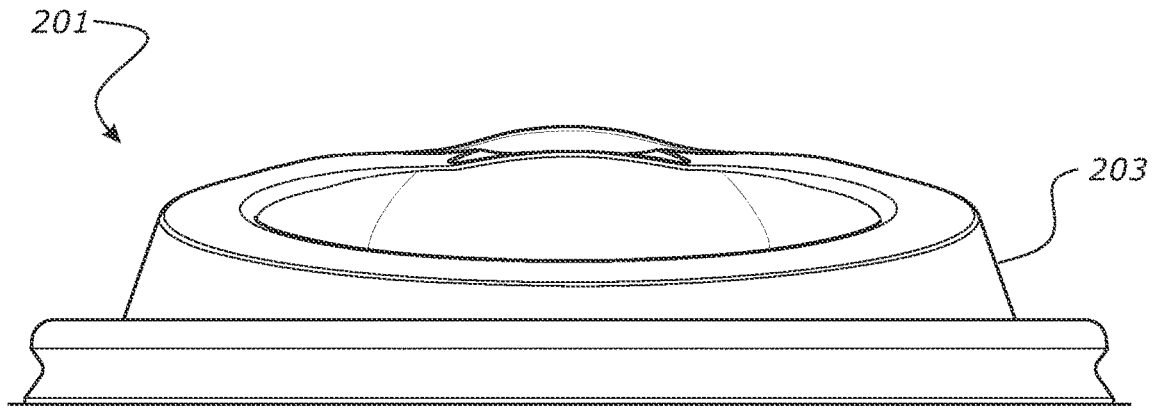
FIG. 28 is a rear view of the lid of FIG. 27.
Figure 39:
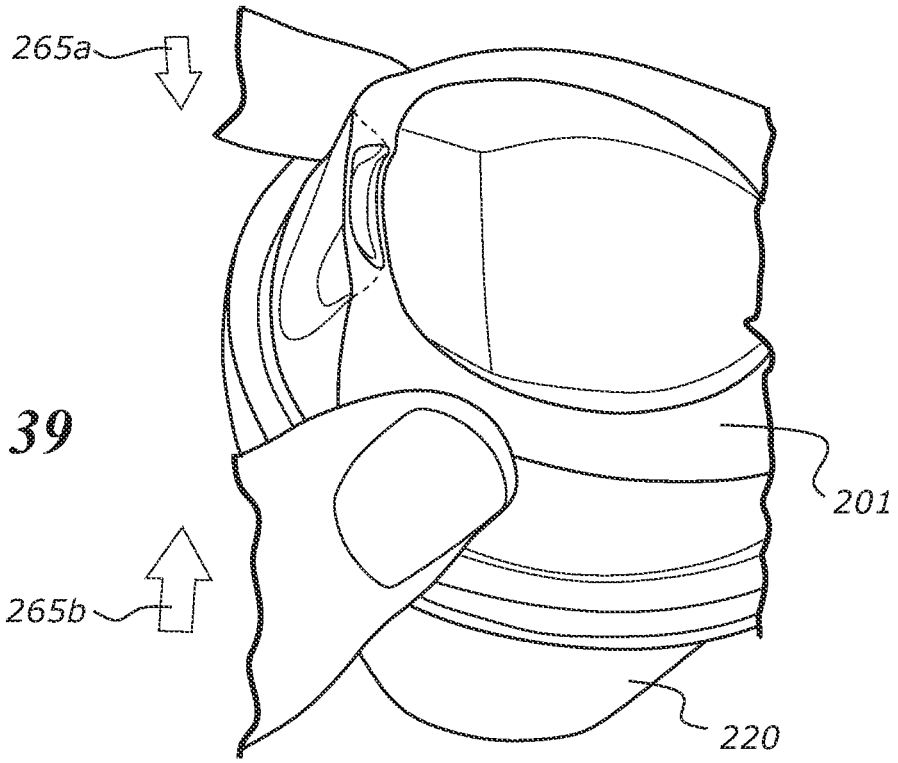
FIG. 39 is a partial perspective view of the lid and container of FIG. 31 showing the direction of force to be applied in order to cause the spout to move from the closed configuration to the open configuration.
Figure 40:
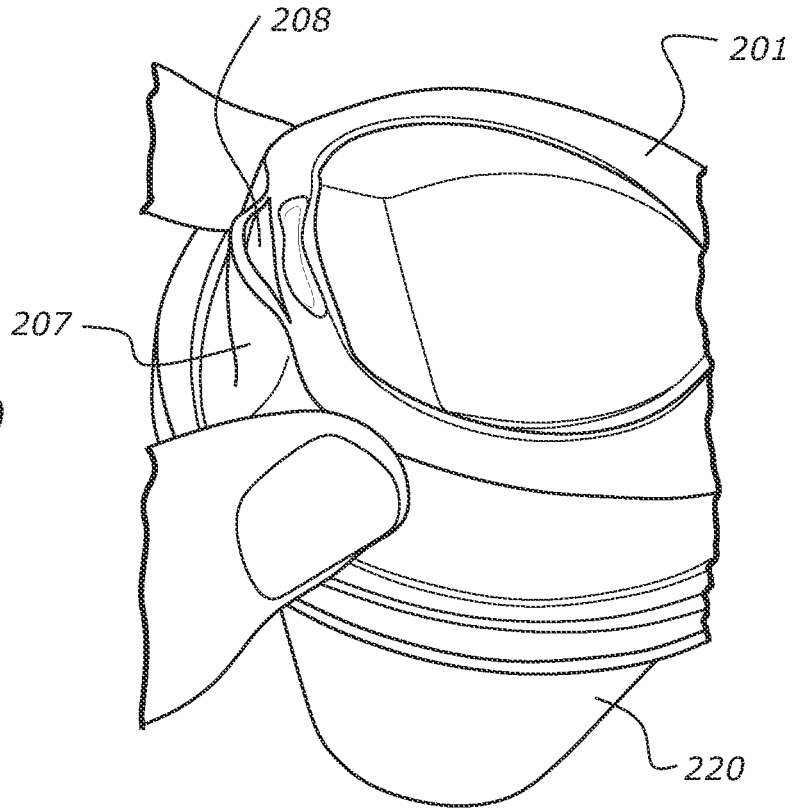
FIG. 40 is a partial perspective view of the lid and container of FIG. 31 showing the spout in the open configuration upon application of force in the direction shown in FIG. 39.
Figure 41:
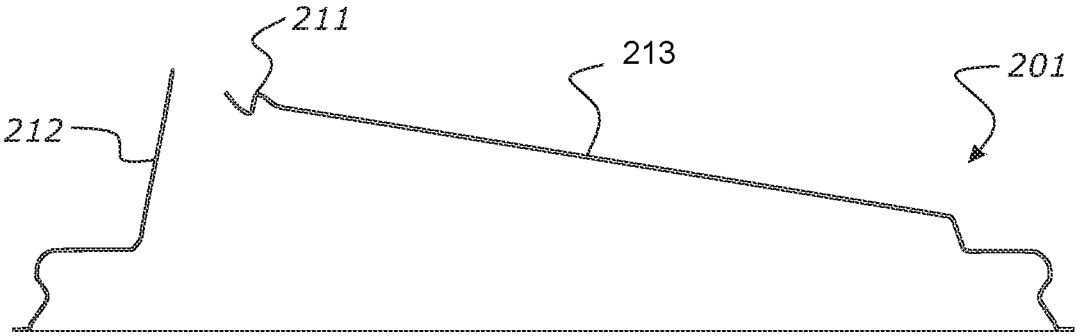
FIG. 41 shows a side schematic view of the spout of the lid of FIG. 27 in the open configuration.
Figure 42:
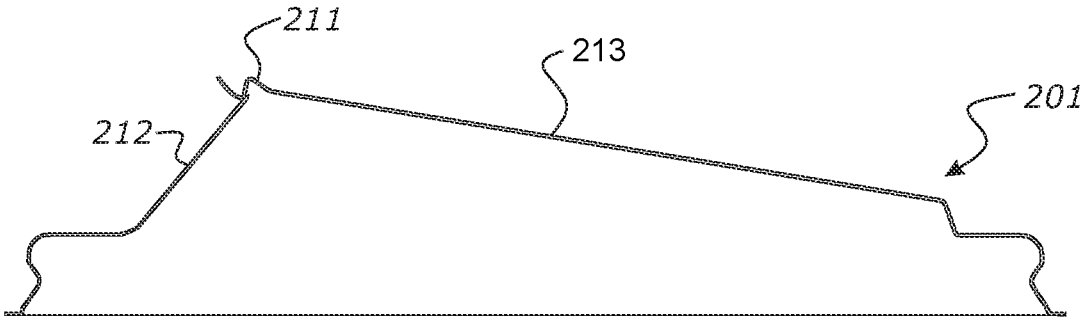
FIG. 42 shows a side schematic view of the spout of the lid of FIG. 27 in the closed configuration.

A first gripping portion 251*a* is formed on the elevated annular portion 203 at one side of the spout 207 and similarly a second gripping portion 251*b* is formed on the elevated annular portion 203 at another side of the spout 207 as shown in FIG. 27. These gripping portions 251*a*, 251*b* may facilitate gripping and pressing or squeezing using a user's fingers as shown in FIGS. 39 and 40

Figure 35:
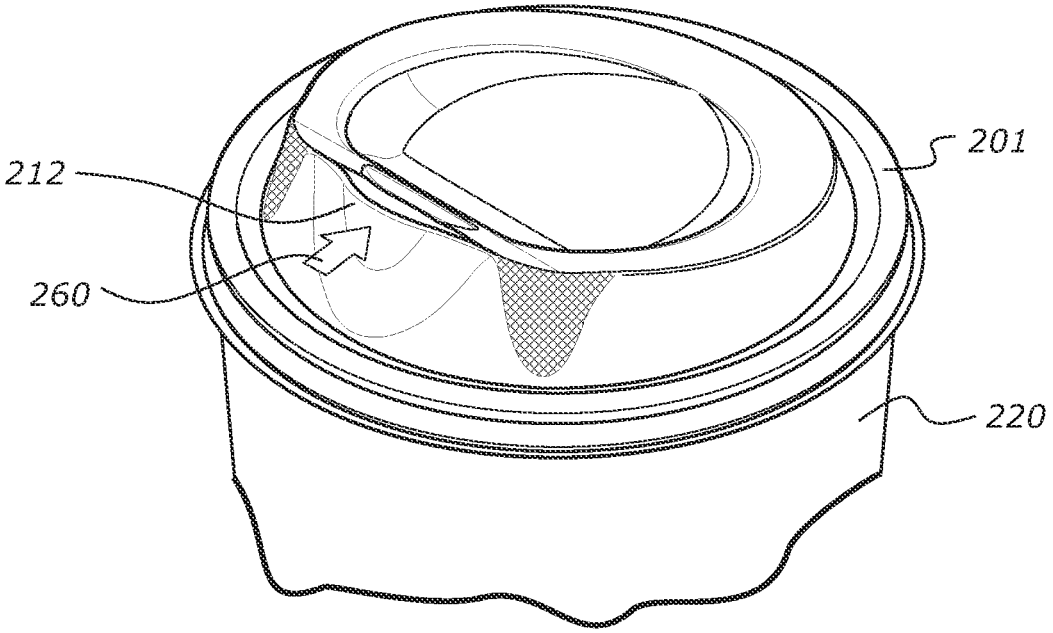
FIG. 35 is a partial perspective view of the lid and container of FIG. 31 showing the direction of force to be applied to cause the spout to move from the open configuration to the closed configuration.
Figure 36:
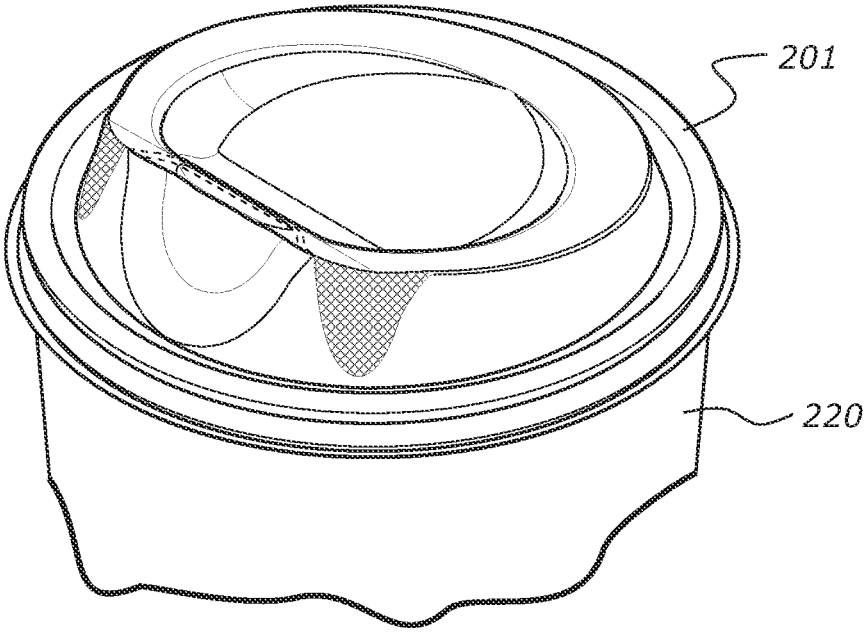
FIG. 36 is a partial perspective view of the lid and container of FIG. 31 showing the spout in the closed configuration upon application of force in the direction shown in FIG. 35.
Figure 37:
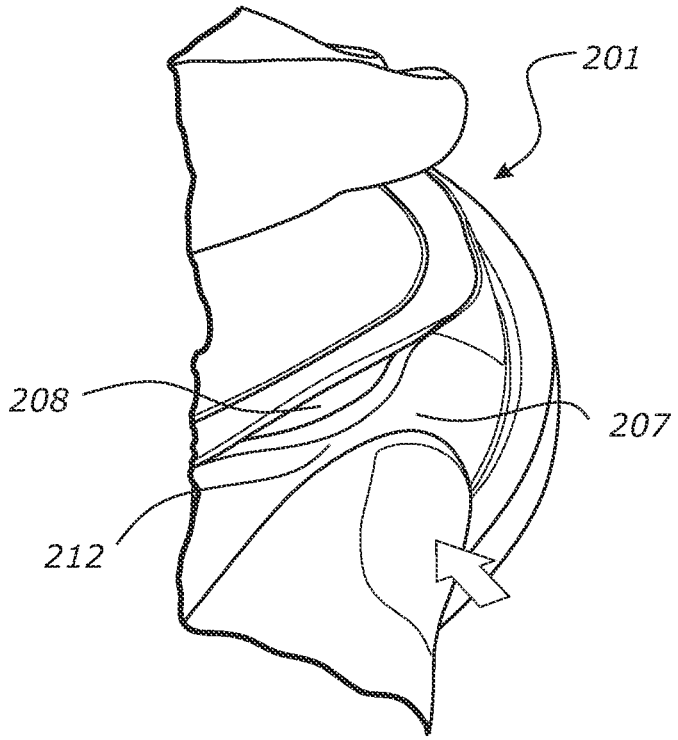
FIG. 37 is a partial perspective view of the lid FIG. 27 showing the direction of the force to be applied using a user's finger in order to cause the spout to move from the open configuration to the closed configuration.
Figure 38:
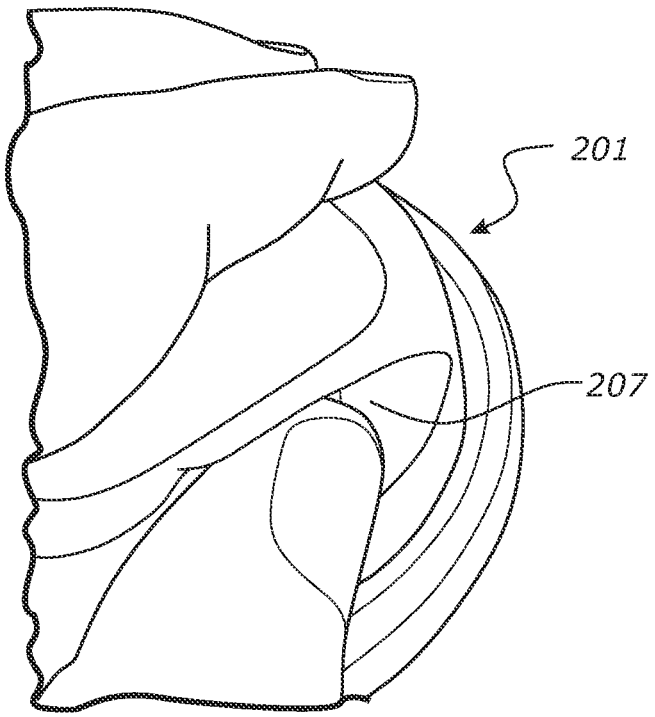
FIG. 38 is a partial perspective view of the lid FIG. 27 showing the spout being move from the open configuration to the closed configuration upon application of force using the user's finger in the direction shown in FIG. 37.

When the spout 207 is in a closed configuration the aperture 208 is closed. Preferably the closed aperture 208 creates a seal sufficient to help prevent liquid from the egressing from the aperture 208. The closed configuration may be achieved by applying force to the end 212 of the spout 207 in the direction of the arrow 260 as shown in FIG. 35. The seal is created between the end 212 of the spout 207 and the elevated portion 203 for example at the top portion 213 of the elevated portion 203. Once force is applied in that direction (shown by arrow 260), the aperture 208 is closed as shown in FIG. 36. The force to close the aperture 208 may be applied to the end 212 of the spout 207 using user's finger (e.g. thumb) as shown in FIGS. 37 and 38.

The spout 207 may be retained in its closed condition by a catch 211. When the spout 207 is in a closed configuration, the spout 207 may engage with the catch 211 as shown in the schematic FIG. 41. The way of manufacturing the catch 211 may be by a number of means, however in the preferred embodiment the catch 211 is an undercut formed in the elevated portion 203 at for example at the top portion 213 of the elevated portion 203. The end 212 of the spout 207 can lodge under the undercut when the spout 207 is in the closed condition. When the spout 207 is not retained by the catch 211, it can return to its open condition. In other embodiments the catch may be a flexible hook, barb, interference fit or many other similar element or device or feature.

When the spout 207 is in an open configuration the aperture 208 is open. The open configuration is shown in FIGS. 29, 30, 31, 32, 34, 35, 37, 40 and 41. Applying a force or squeezing the lid towards the direction of the arrows 265*a*, 265*b* as shown in FIG. 39 results in the spout 207 moving from a closed configuration (shown in FIG. 39) to an open configuration as shown in FIG. 40. The end 212 moves relative to the rest of the lid in a direction away from elevated portion 203 (i.e. towards outward direction of the lid/container) to create the opening in the form of the aperture 208.

The preferred action of squeezing the annular base 202, or lid 201, or container 220, in a direction orthogonal to the direction of the spout, and towards the centre of the annular base 202, will have the effect of moving the catch 211 away from the end 212 of the spout 7. In one embodiment, where the container 220 is a circular rimmed cup, the effect of squeezing the container 220 to a more elliptical shape will move the catch 211 away from the end 212 so as to release from the spout 207. The spout 207 can then move or caused to be moved to its open configuration. Once the spout 207 is released from the catch 211, the spout 207 may be in the open configuration.

As shown in FIGS. 39 and 40, a preferred method to open the aperture 208 is to apply a force at gripping portions 251*a*, 251*b* using user's fingers. In other words, the user may use his/her fingers to squeeze the lid 207 at the gripping portion 251*a*, 251*b* thereby applying a force on the lid 201 that causes the spout 207 to transition from a closed configuration to an open configuration. The force needs to be applied towards the centre of the annular base 202. As shown, the gripping portions 251*a*, 251*b* may comprise textured profile (hatched feature, preferably, cross-hatched feature) to facilitate gripping using user's fingers. Such textured profile on exterior surface of the gripping portion also provides visual indication to the user regarding the location of the gripping portions 251*a*, 251*b*. Such visual indication helps to minimise the risk of damage or accidental spillage of contents inside the container 220 due to application of force at the incorrect portion of the lid 207.

Another method of releasing the spout 207, is to pull the catch 211 away from the end 212. A further method of releasing the spout 207, is to pull up on the spout 207 and in order to facilitate pulling of the spout 207, the end 212 may comprise a tab (not shown) that is similar to tab 9, 109 as described above in the previous embodiments. The effect of pulling on the tab of the spout 207 will merely bend the spout 207 so that it can get out from underneath the catch 211.

The spout 207 and aperture 208 may be adapted such that they help to provide a natural flow of liquid when open and in use. The dimensions of the spout 207 and aperture 208 may be based around at least one of (a) typical mouth size of users (b) liquid volumes to escape and (c) comfortable angles for the liquid to pour into a user's mouth.

Figure 43:
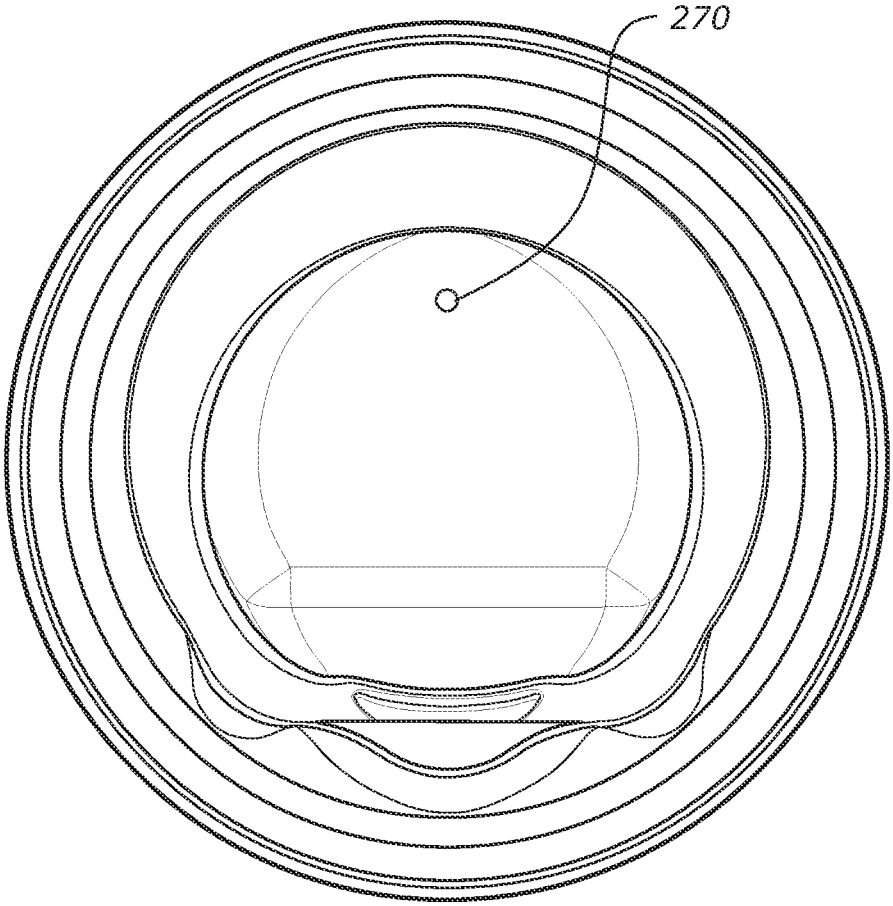
FIG. 43 is a top plan view of the lid of FIG. 27 showing an air circulation hole.

As shown in FIG. 43, the lid 201 may optionally comprise air circulation hole 270 on lid top. Such air circulation hole 270 can help improve liquid flow. Air circulation hole 270 may assist in pressure regulation. The air circulation hole can also provide ventilation.

In use, a user places the annular rim of the base 202 around the circumference of a drinking edge of the container 220. If an inner annular wall is present, such inner annular wall is present inside the container such that a secure fit is made. A user can then decide whether to keep the spout 207 closed to transport the contained liquid and help maintain the temperature of the liquid or to open the spout 207 by either popping the spout 207 open or by applying force on the gripping portions 251*a*, 251*b* towards the direction of the inside of the container 220 which results in the spout 207 moving to a drinking or open configuration. Once the spout 207 is in the open or drinking configuration a user can drink the liquid contained within the container via the aperture 208. As the spout 207 can be opened and closed the user can either finish drinking all the liquid or close the spout 207 and drink the remaining liquid at a later point in time.

Therefore, it will be appreciated that the lid 1, 101, 201 comprises a formation in a non-peripheral region that is able to be pressed or already pressed, to a condition that at least substantially closes a flowable material egress opening (i.e. aperture 8, 108, 208). The formation is able to be released from that condition to allow material egress from the container via the material egress opening. The formation may be a spout 7, 107, 207.

It will be appreciated that the lid 1, 101, 201 and its various parts can be produced in a range of different sizes. It will also be appreciated that the lid 1, 101 201, can be made in a number of different ways such as injection formed, vacuum formed, compression molding, pressure forming, and hydro forming etc. The lid 1, 101, 201 can also be made from a number of different materials however most preferably the lid is made from plastic and most preferably a biodegradable plastic. In one preferred embodiment the lid 1, 101 201 is made substantially from CPLA (crystallised polylactic) which is a compostable polymer. In another preferred embodiment the lid 1, 101, 201 is made substantially from PP (polypropylene). In another preferred embodiment the lid 1, 101, 201 is made substantially from PP (polypropylene) at 0.5 mm gauge.

The opening of the spout may be of many sizes. In the most preferred form the flow area is at around 1.2 cm^2. A typical range may be 0.8 cm^2 to 1.5 cm^2.

The two diameters of the lids may for example be, 'Regular' and 'Large' which are 80 mm and 90 mm respectively.

The lid 1, 101 may optionally comprise air circulation hole similar to circulation hole 270 on lid top in order to improve liquid flow.

The lid 1, 101, 201 has a number of benefits and advantages over known lids. It can be opened and closed by the user which minimises accidental spillage. When closed the spout also helps to maintain the temperature of the liquid in the container for longer. The lid is also user friendly as is easy to use and allows liquid to escape in a more ergonomic fashion when the spout is open. The inner wall 6, 106 of the lid 1, 101 also makes the lid 1, 101 to container connection more secure than known lids. Such inner walls may also be present in lid 201. The simple squeezing manner that allows the spout 7, 107, 207 to move/transition to its open configuration is an important aspect of at least some embodiments of invention. The simple squeezing manner can be performed with one hand, while the same hand can also be used to carry the container.

Although in the preferred embodiments the lid 1, 101, 201 is for a container it will be appreciated by those skilled in the art that the lid 1, 101, 201 could be used on other items for example the lid 1, 101,201 could be used for any type of container which has an open top which flowable material such as a liquid or granular solids (e.g. sugar) or paste or sauce or the like is poured out of.

It will be appreciated that having a spout 7, 107, 207 and aperture 8, 108, 208 of a particular shape/structure as shown in the drawings is advantageous as such triangular and convex shape/structure does not allow ice cubes to fully block flow of liquid from the aperture 8, 108, 208. Further such shape/structure is adapted to suit drinking thicker or more viscous liquids such as smoothies or milkshakes.

It is to be understood that even though numerous characteristics and advantages of the various embodiments of the present invention have been set forth in the foregoing description, together with details of the structure and functioning of various embodiments of the invention, this disclosure is illustrative only, and changes may be made in detail so long as the functioning of the invention is not adversely affected. For example the particular elements of the lid 1, 101 such as the base 2, 102, internal wall 6, 106, elevated portion 3, 103, spout 7, 107 and tab 9, 109 may vary dependent on the particular application for which it is used without variation in the spirit and scope of the present invention.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

The invention claimed is:

1. A lid for closing, an opening of a container that is able to contain a flowable material, the lid comprising a peripheral region engaging, or able to engage, about, within or both about and within the container at the opening of the container and a lid top provided inwardly of the peripheral region;

wherein the lid top includes an integrally formed spout formation that, by a live hinge, is substantially separated from the rest of the lid top, the spout formation:

i. able to be pressed, or already pressed, in a direction towards the container when engaged to the container, to a retainable or retained condition that at least substantially closes a flowable material egress opening of the non-peripheral region and ii. able to be released from that condition to move away from the container upon a compression of the lid top in a direction lateral to the elongate direction of the spout formation when engaged to the container to allow flowable material egress via the opening, wherein an annular wall extending upwardly to the lid top has a catch formation provided with which the end of the spout is adapted to lodge to be retained in the depressed condition, wherein the annular wall at the catch formation is adapted to displace relative the end of the spout in a radial direction upon a compression of the lid top in a direction lateral to the elongate direction of the spout formation, and wherein the spout formation is biased to its material egress condition.

2. A lid to releasably engage to the rim of an open topped cup or container, the lid comprising:

a. a lip engaging, or able to engage, about, within or both about and within the rim of the container, b. an annular wall extending upwardly relative the lip, c. a lid top at the top of the annular wall, the annular wall presenting an elongate formation in the form of a spout raised out from the annular wall, an end of which is elevated above the lid top and defines a closable opening with and at the lid top via which material in the container can egress, the formation separated at least partially from the remainder of the annular wall by a live hinge to allow:

i. the spout to be depressed towards the annular wall to cause the end of the spout to contact the lid top to thereby close the closable opening, and ii. the annular wall to be compressed in a direction lateral to the elongate direction of the formation to lift the spout away from the annular wall to thereby open the closable opening, wherein the end of the spout when depressed and is in a depressed condition is able to lodge under a catch formation of the annular wall to be retained by the catch formation and retain the closable opening in the closed condition, wherein the lodged condition of the spout with the catch formation is able to be dislodged upon a compression of the lid top causing relative movement of the end of the spout with the catch formation, wherein the live hinge is adapted and configured to bias the spout away from the depressed condition of the spout so that when the spout is dislodged from the catch formation the spout assumes a condition where the closeable opening is open.

* * * * *